US005960731A

United States Patent [19]

Kubota

[11] Patent Number: 5,960,731

[45] Date of Patent: Oct. 5, 1999

[54] CONTROL METHOD OF CONTOUR SEWING MACHINE AND CONTROL APPARATUS THEREOF

[75] Inventor: Tuguo Kubota, Tokyo, Japan

[73] Assignee: Juki Corporation, Tokyo, Japan

[21] Appl. No.: 09/219,982

[22] Filed: Dec. 23, 1998

[30] Foreign Application Priority Data

Dec. 26, 1997 [JP] Japan ..... 9-360431

[51] Int. Cl.[6] ..... D05B 21/00

[52] U.S. Cl. ..... 112/470.04; 112/470.06

[58] Field of Search ..... 112/470.04, 470.06, 112/102.5, 456, 458, 300, 475.19; 364/470.09

[56] References Cited

U.S. PATENT DOCUMENTS

| | | | |
|---|---|---|---|
| 4,455,956 | 6/1984 | Yamamoto et al. . | |
| 4,796,551 | 1/1989 | Nukushina | 112/475.19 |
| 5,195,451 | 3/1993 | Nakashima | 112/102.5 |

FOREIGN PATENT DOCUMENTS

| | | |
|---|---|---|
| 8-84877 | 4/1996 | Japan . |

*Primary Examiner*—Peter Nerbun
*Attorney, Agent, or Firm*—Morgan & Finnegan LLP

[57] ABSTRACT

The object of the present invention is to provide a sewing movement control method and a contour sewing machine wherein sewing data can be shared. To achieve the above object, the contour sewing machine according to the present is provided with sewing holding means, a pair of driving motors, sewing conveyance means for converting at least one of the driving force of the pair of driving motors to approximate linear motion, converting the other to approximate linear motion or linear motion and transmitting the driving force of the pair of driving motors so that the sewing holding means is moved in longitudinal and transverse two directions approximately perpendicular, an auxiliary storage for storing sewing data composed of coordinate values in a moved position from a home position at rectangular coordinates, data input means, correction table storage means for storing a correction table for correcting the driven quantity of each driving motor corresponding to coordinate values in the sewing data and control means for controlling the driven quantity of the pair of driving motors based upon a value obtained based upon coordinate values and the correction table.

9 Claims, 17 Drawing Sheets

| | X CORRECTION VALUE | Y CORRECTION VALUE |
|---|---|---|
| XY CORRECTION VALUES FOR (-51.0, -31.0) | -123 | -55 |
| XY CORRECTION VALUES FOR (-50.0, -31.0) | -120 | -53 |
| XY CORRECTION VALUES FOR (-49.0, -31.0) | -117 | -51 |
| | ↓ | ↓ |
| XY CORRECTION VALUES FOR (+49.0, -31.0) | 117 | -51 |
| XY CORRECTION VALUES FOR (+50.0, -31.0) | 120 | -53 |
| XY CORRECTION VALUES FOR (+51.0, -31.0) | 123 | -55 |
| XY CORRECTION VALUES FOR (-51.0, -30.0) | -120 | -55 |
| XY CORRECTION VALUES FOR (-50.0, -30.0) | -117 | -53 |
| XY CORRECTION VALUES FOR (-49.0, -30.0) | -114 | -51 |
| | ↓ | ↓ |
| XY CORRECTION VALUES FOR (+49.0, +30.0) | -74 | -72 |
| XY CORRECTION VALUES FOR (+50.0, +30.0) | -74 | -75 |
| XY CORRECTION VALUES FOR (+51.0, +30.0) | -74 | -78 |
| XY CORRECTION VALUES FOR (-51.0, +31.0) | 78 | -79 |
| XY CORRECTION VALUES FOR (-50.0, +31.0) | 78 | -76 |
| XY CORRECTION VALUES FOR (-49.0, +31.0) | 78 | -73 |
| | ↓ | ↓ |
| XY CORRECTION VALUES FOR (+49.0, +31.0) | -78 | -73 |
| XY CORRECTION VALUES FOR (+50.0, +31.0) | -78 | -76 |
| XY CORRECTION VALUES FOR (+51.0, +31.0) | -78 | -79 |

FIG.12

CONTROL METHOD OF CONTOUR SEWING MACHINE AND CONTROL APPARATUS THEREOF

BACKGROUND OF THE INVENTION

1. Field of the Invention

The present invention relates to a sewing movement control method and a contour sewing machine, particularly relates to a sewing movement control method and a contour sewing machine in which sewing holding means for holding sewing can be moved along the surface of a bed so that predetermined contour sewing is executed.

2. Description of the Related Art

Heretofore, a contour sewing machine for executing predetermined contour sewing for sewing is known. Such a contour sewing machine is constituted so that sewing holding means for holding sewing by the driving force of a pair of driving motors respectively composed of a pulse motor arranged in the lower part of a bed with its output shaft perpendicular to the bed and also called a stepping motor and others is moved at rectangular coordinates (the X-Y coordinates) in longitudinal and transverse two directions (XY directions) mutually perpendicular, which is called XY driving.

Recently, a contour sewing machine in which sewing holding means can be moved in longitudinal and transverse two different directions approximately perpendicular by converting the operation of one of a pair of driving motors to approximate linear motion so-called circular arc motion, converting the operation of the other to approximate linear motion or linear motion and moving the sewing holding means curvedly such as in a circular arc approximating to a straight line in at least one direction for the reason of miniaturization and others is known.

For a contour sewing machine in which sewing holding means is moved in longitudinal and transverse two directions approximately perpendicular along the surface of a bed by converting both driving force of a pair of driving motors to approximate linear motion called circular arc motion, the following are known.

For example, in U.S. Pat. No. 4,455,956, a contour sewing machine provided with a pair of driving motors respectively composed of a pulse motor arranged in the lower part of a bed with its output shaft perpendicular to the bed, a pair of sectorial spur gears for being engaged with a pinion gear fixed to the output shaft of each driving motor, a series of a group of levers for approximately moving sewing holding means in one direction (in the direction of the y-axis, that is, longitudinally) along the surface of a bed according to the reciprocation of one sectorial spur gear and a series of a group of levers for approximately moving the sewing holding means in the other direction (in the direction of the x-axis, that is, transversely) along the surface of the bed according to the reciprocation of the other sectorial spur gear is disclosed.

Further, for another example, in Japanese published unexamined patent application No. Hei8-84877, a contour sewing machine provided with a pair of driving motors arranged in the lower part of a bed with its output shaft level with the bed, helical engagement means coaxially fixed to the output shaft of each driving motor, an engagement piece which is engaged with the helical engagement means and can be moved in the axial direction of the output shaft of the driving motor, a series of a group of levers for reciprocating the movement in the axial direction of one engagement piece by a linear lever and approximately moving sewing holding means in one direction (in the direction of the y-axis, that is, longitudinally) along the surface of the bed, a series of a group of levers for reciprocating the movement in the axial direction of the other engagement piece by a L-type lever and approximately moving the sewing holding means in the other direction (in the direction of the x-axis, that is, transversely) along the surface of the bed is disclosed.

In the above each contour sewing machine, the data of the driven quantity (the number of pulses) of the pulse motor which is the driving motor for moving the sewing holding means by linear driving or driving in a circular arc which is approximate linear motion is collected as sewing data for contour sewing and stored in data storage means such as programmable ROM (PROM) and in case contour sewing is executed, the integral times (resolution in data/the resolution of pulse motors) of the sewing data is output.

However, in the above conventional type contour sewing machines in which at least one of different directions is driving in a circular arc, as the sewing holding means is moved in a circular arc which is at least one of different directions, there is a problem that a position from a home position to which the sewing holding means is moved cannot be precisely controlled only by simply enlarging or reducing sewing data, so-called distortion of a contour is caused and if particularly, a sewing area is large, the distortion of a contour is increased.

In the contour sewing machines of the related art, there is another problem that different sewing data is required because of difference between methods (XY driving and driving in a circular arc) of moving the sewing holding means by a pair of driving motors and much labor and time are required to generate sewing data.

Further, in the above related contour sewing machines wherein at least one of directions in which the sewing holding means is moved is driving in a circular arc, quantity in which the sewing holding means is moved may be different depending upon the resolution of each pulse motor and in such a case, there is a problem that dedicated sewing data is required and more labor and time are required to generate sewing data.

Furthermore, in a contour sewing machine wherein a sewing pattern in which a sewing contour is recorded is stored in sewing holding means and sewing data can be input by moving the sewing holding means according to the sewing pattern, there is a problem that only in a contour sewing machine to which sewing data is input, can the sewing data can be generated and used.

That is, in a related contour sewing machine, there is a problem that sewing data cannot be shared because of difference in a driving method and in a sewing area.

SUMMARY OF THE INVENTION

The present invention is made in view of these points and the object is to provide a sewing movement control method in which sewing data can be shared and to provide a contour sewing machine which can readily execute the above sewing movement control method.

To achieve the above object, a sewing movement control method according to the present invention is characterized in that a position to which sewing holding means is moved is controlled by values obtained based upon sewing data composed of coordinate values in the position moved from a home position at rectangular coordinates in longitudinal and transverse two directions mutually perpendicular and a correction table for correcting the driven quantity of each driving motor corresponding to the above coordinate values. By adopting such constitution, sewing data can be shared independent of difference between methods (XY driving and driving a circular arc) of moving the sewing holding means by a pair of driving motors. That is, as the existing sewing data when the sewing holding means is moved in longitudinal and transverse directions can be shared as sewing data in case at least one of the mutually different moved directions of the sewing holding means is driving in a circular arc by composing the sewing data of coordinate values at rectangular coordinates (the X-Y coordinates), labor and time required to generate the sewing data can be reduced. Further, as the driven quantity of each driving motor can be readily corrected according to the sewing data by applying a suitable value in the correction table independent of a case that at least one of the mutually different moved directions of the sewing holding means is driving in a circular arc, the enlargement or reduction of a contour when at least one of the mutually different moved directions of the sewing holding means is driving in a circular arc, the difference in size between sewing areas when at least one of the mutually different moved directions of the sewing holding means is driving in a circular arc and others, the suitable moved position of the sewing holding means can be securely obtained and as a result, the distortion of a contour in case contour sewing is executed by moving the sewing holding means in a circular arc can be readily and securely prevented.

A contour sewing machine according to the present invention is also characterized in that sewing holding means which holds sewing and can be moved, a pair of driving motors, sewing conveyance means for transmitting the driving force of the above pair of driving motors by converting at least one of the driving force of the pair of driving motors to approximate linear motion and converting the other to approximate linear motion or linear motion so that the sewing holding means is moved in longitudinal and transverse two directions approximately perpendicular along the surface of a bed, an auxiliary storage for storing sewing data composed of coordinate values in the position of the sewing holding means moved from a home position at rectangular coordinates in longitudinal and transverse two directions mutually perpendicular, data input means from/to which the sewing data stored in the auxiliary storage can be read or read and written, correction table storage means for storing a correction table for correcting the driven quantity of each driving motor corresponding to coordinate values in the sewing data and control means for controlling the driven quantity of the pair of driving motors based upon values obtained based upon coordinate values in the moved position of the sewing holding means and the above correction table are provided. By adopting such configuration, the sewing movement control method can be executed, that is, a position to which the sewing holding means is moved can be controlled based upon the sewing data composed of coordinate values in the moved position from the home position at rectangular coordinates in longitudinal and transverse two directions mutually perpendicular and the correction table for correcting the driven quantity of each driving motor corresponding to the above coordinate values and as a result, the sewing data can be shared independent of difference between methods (XY driving and driving in a circular arc) of moving the sewing holding means by a pair of driving motors. That is, as the existing sewing data of a contour sewing machine in which sewing holding means is moved in the directions of X and Y can be shared as the sewing data of a contour sewing machine in which at least one of the mutually different moved directions of sewing holding means is driving in a circular arc, labor and time required to generate the sewing data can be reduced. Further, as the driven quantity of each driving motor can be readily corrected according to the sewing data by applying a suitable value independent of a case that at least one of the mutually different moved directions of the sewing holding means is driving in a circular arc, the enlargement or reduction of a contour when at least one of the mutually different moved directions of the sewing holding means is driving in a circular arc, difference in size between sewing areas when at least one of the mutually different moved directions of the sewing holding means is driving in a circular arc and others, the suitable moved position of the sewing holding means can be securely obtained and as a result, as the distortion of a contour in case contour sewing is executed by moving the sewing holding means in a circular arc can be readily and securely prevented, predetermined contour sewing can be suitably and securely executed. Furthermore, as the sewing data can be shared, an input device for generating the sewing data is not required to be provided every sewing machine. That is, sewing data can be also generated by a personal computer and others.

A contour sewing machine according to the present invention is also characterized in that sewing holding means which holds sewing and can be moved, a pair of driving motors, sewing conveyance means for transmitting the driving force of the above pair of driving motors by converting one of the driving force of the pair of driving motors to approximate linear motion and converting the other to approximate linear motion or linear motion so that the sewing holding means is moved in longitudinal and transverse two directions approximately perpendicular along the surface of a bed, an auxiliary storage for storing sewing data composed of the moved quantity from a home position of the sewing holding means at rectangular coordinates in longitudinal and transverse two directions mutually perpendicular, data input means from/to which the sewing data stored in the auxiliary storage can be read or read and written, data conversion means for converting the moved quantity of the sewing holding means as the sewing data to coordinate values in the moved position, correction table storage means for storing a correction table for correcting the driven quantity of each driving motor corresponding to the coordinate values converted from the sewing data and control means for controlling the driven quantity of the pair of driving motors based upon values obtained based upon the coordinate values in the moved position of the sewing holding means and the correction table are provided. By adopting such configuration, the data conversion means can readily convert the driven quantity of the sewing holding means as sewing data to coordinate values at rectangular coordinates in the moved position.

A contour sewing machine according to the present invention is also characterized in that in the above correction table, correction values are given only to coordinate values at a fixed interval at the above rectangular coordinates. By adopting such constitution, the quantity of data can be reduced and as a result, the storage capacity of the correction table storage means for storing the correction table can be reduced.

A contour sewing machine according to the present invention is also characterized in that the above control means adopts a correction value for coordinate values in a correction table the nearest to the coordinate values in the moved position from a home position of the above sewing holding means for a correction value for coordinate values in the moved position from the home position of the sewing holding means if a correction value for coordinate values in the moved position from the home position of the sewing holding means is not found in the correction table. By adopting such constitution, even if a corresponding correction value is not found in a correction table, a suitable correction value can be readily obtained and as a result, predetermined contour sewing can be suitably and readily executed using a correction table having only small quantity of data.

A contour sewing machine according to the present invention is also characterized in that the above control means complementarily calculates each correction value for coordinate values in a correction table at four points the nearest to coordinate values in the moved position from a home position of the above sewing holding means based upon the coordinate values in the correction table at the four points and the coordinate values in the moved position from the home position of the sewing holding means if a correction value for coordinate values in the moved position from the home position of the sewing holding means is not found in the correction table and the values calculated in the above complementary calculation are used for a correction value for the coordinate values in the moved position from the home position of the sewing holding means. By adopting such constitution, even if a correction value is not found in the correction table, a more suitable correction value can be readily obtained and as a result, predetermined contour sewing can be more suitably and readily executed using the correction table having only small quantity of data.

BRIEF DESCRIPTION OF THE DRAWINGS

FIG. 12 is an explanatory drawing showing an example of the configuration of a correction table;

DESCRIPTION OF THE PREFERRED EMBODIMENTS

Figure 1:
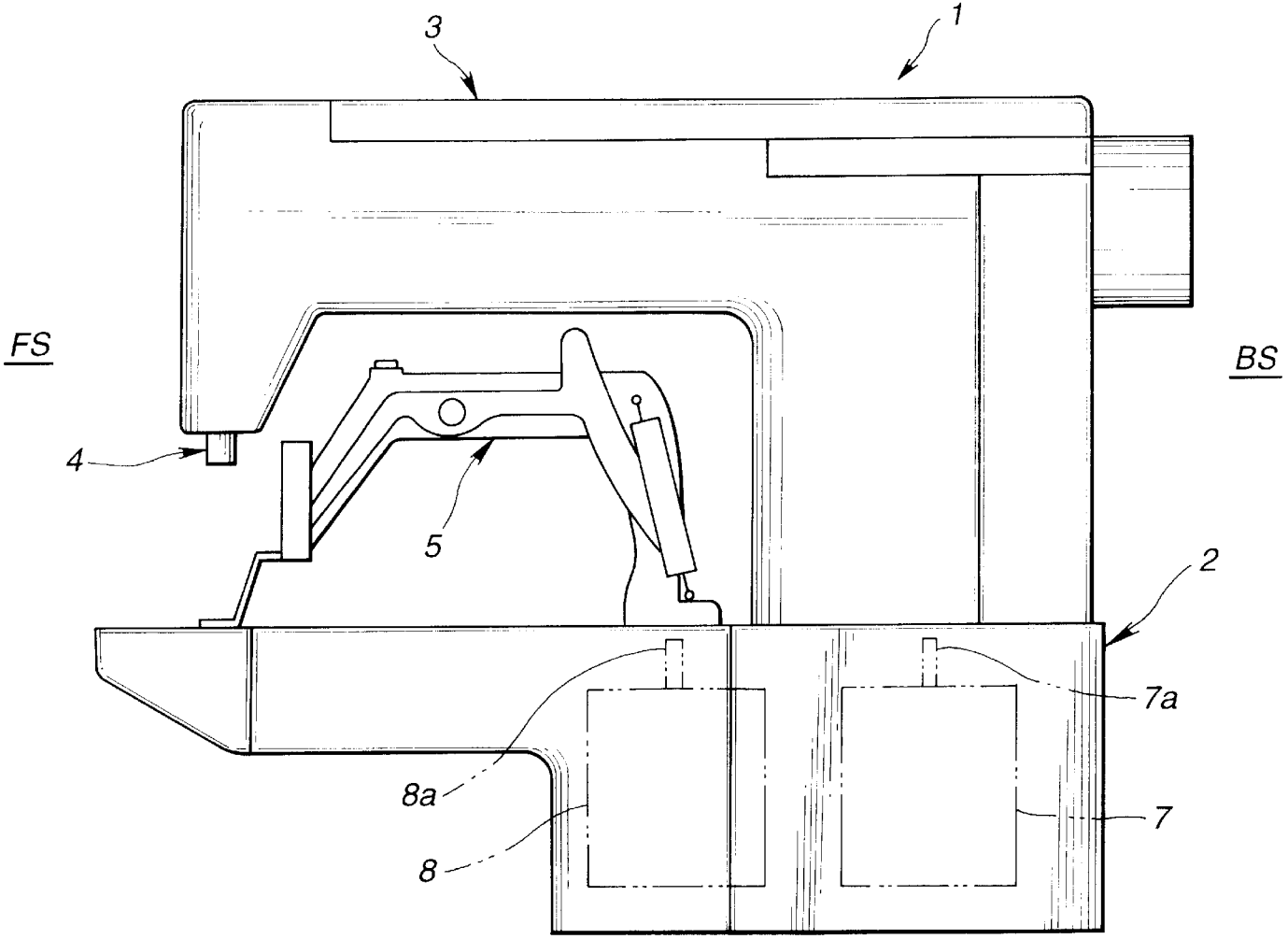
FIG. 1 is an outside drawing showing the main part of the whole configuration in an embodiment of a contour sewing machine according to the present invention.

The present invention will be described based upon embodiments shown in the drawings below.

Figure 2:
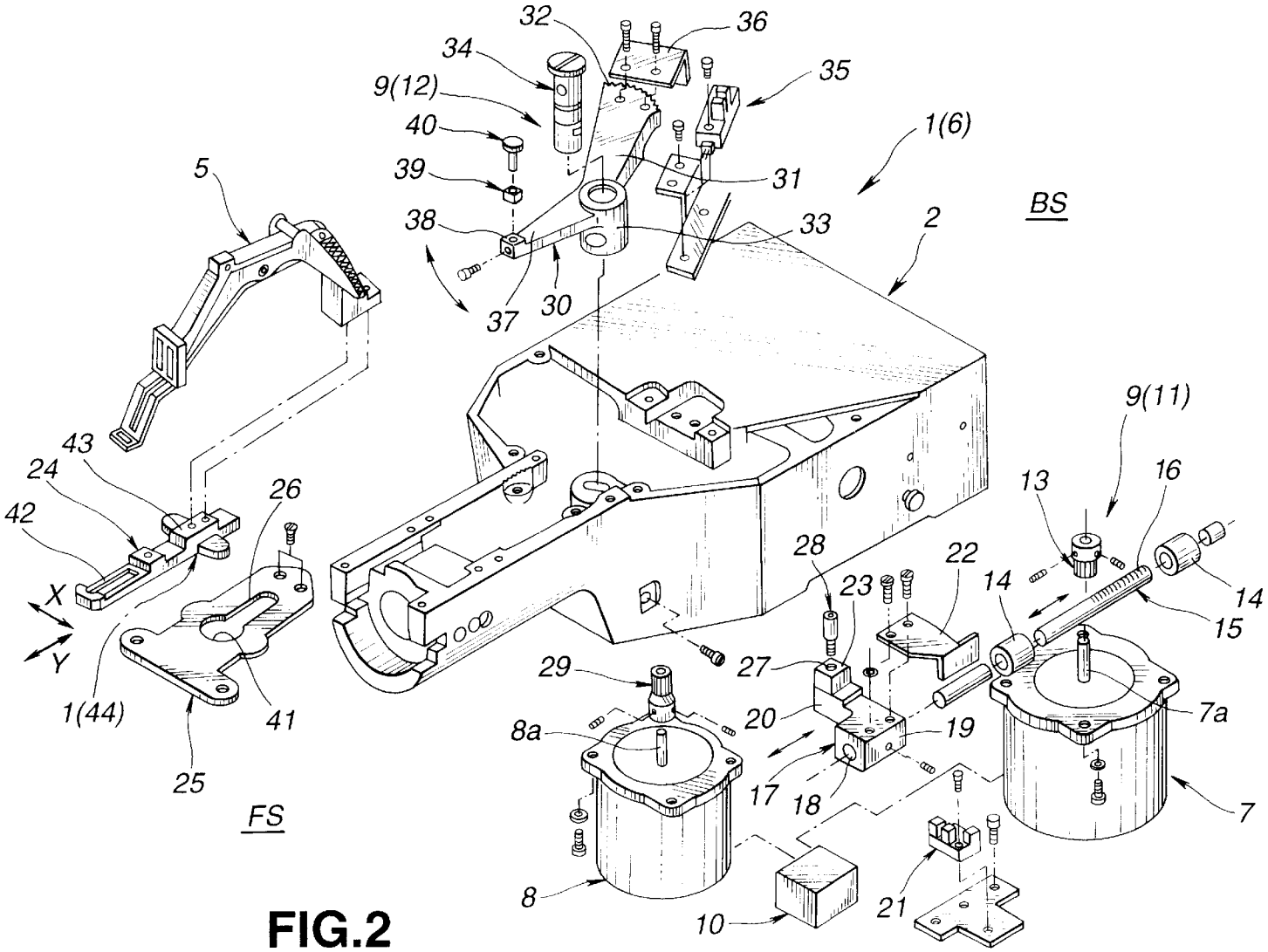
FIG. 2 is an exploded perspective view showing the main part of the internal configuration of a bed.
Figure 3:
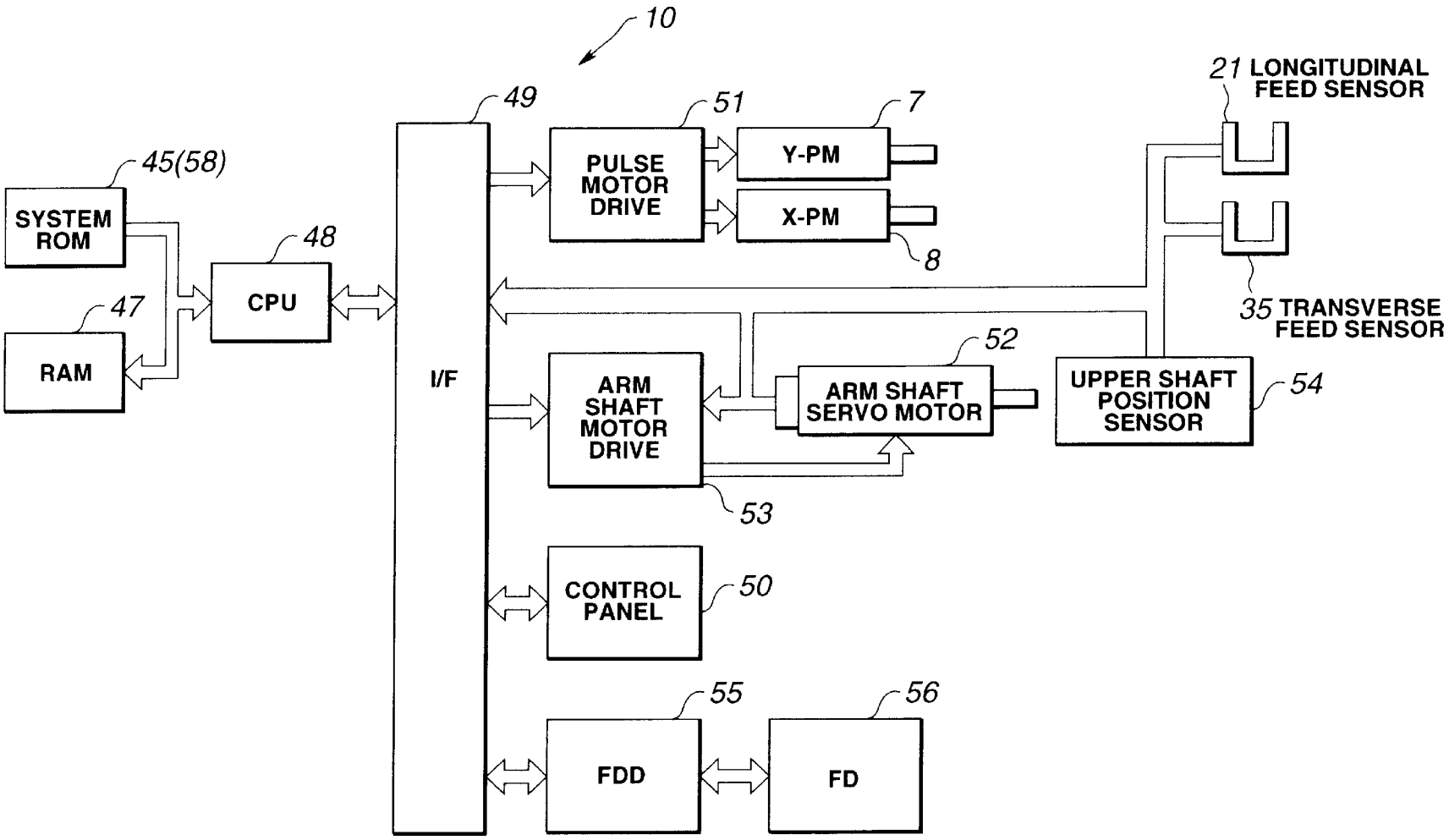
FIG. 3 is a block diagram showing the configuration of the main part of control means.
Figure 4:
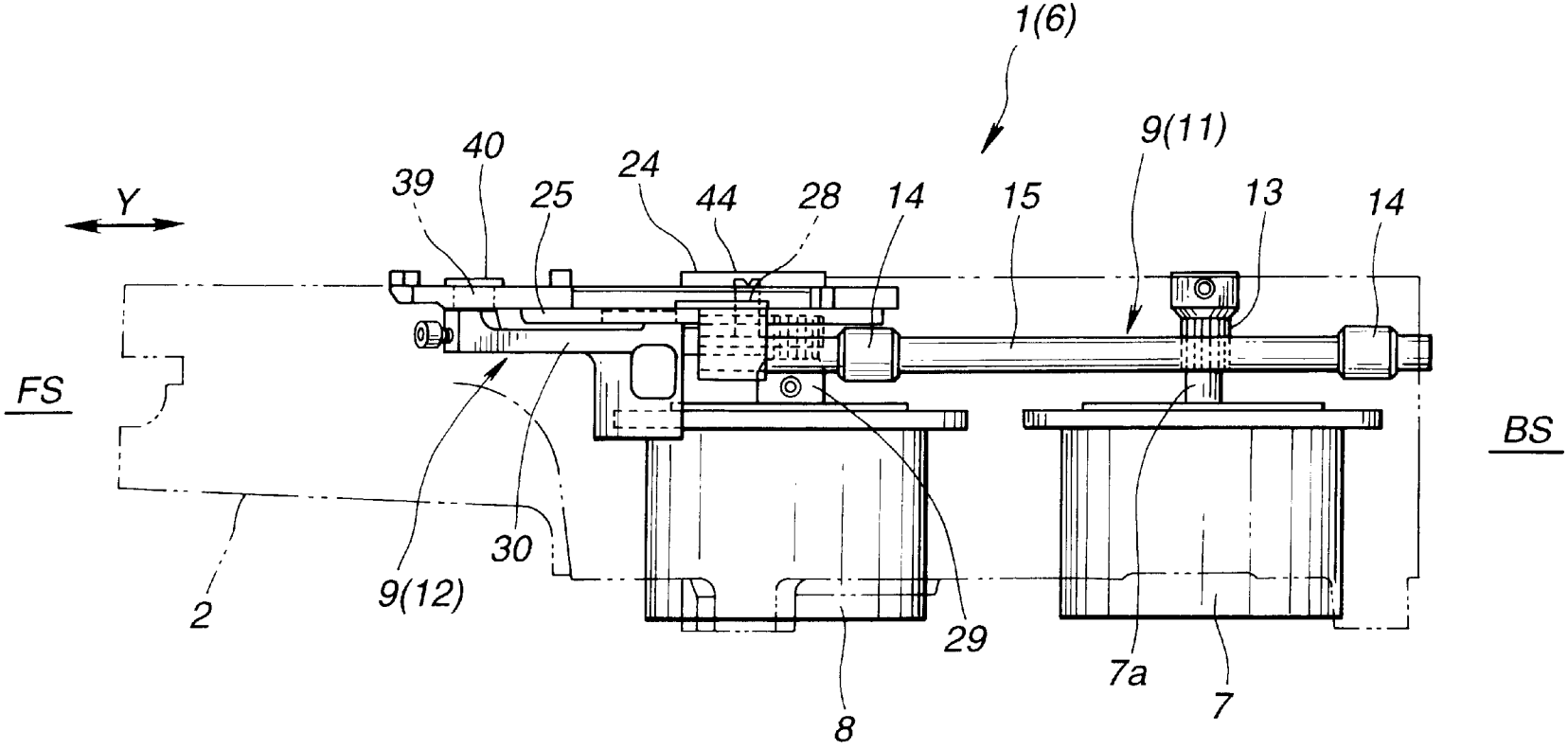
FIG. 4 is a front view showing the main part of the internal configuration of the bed.
Figure 5:
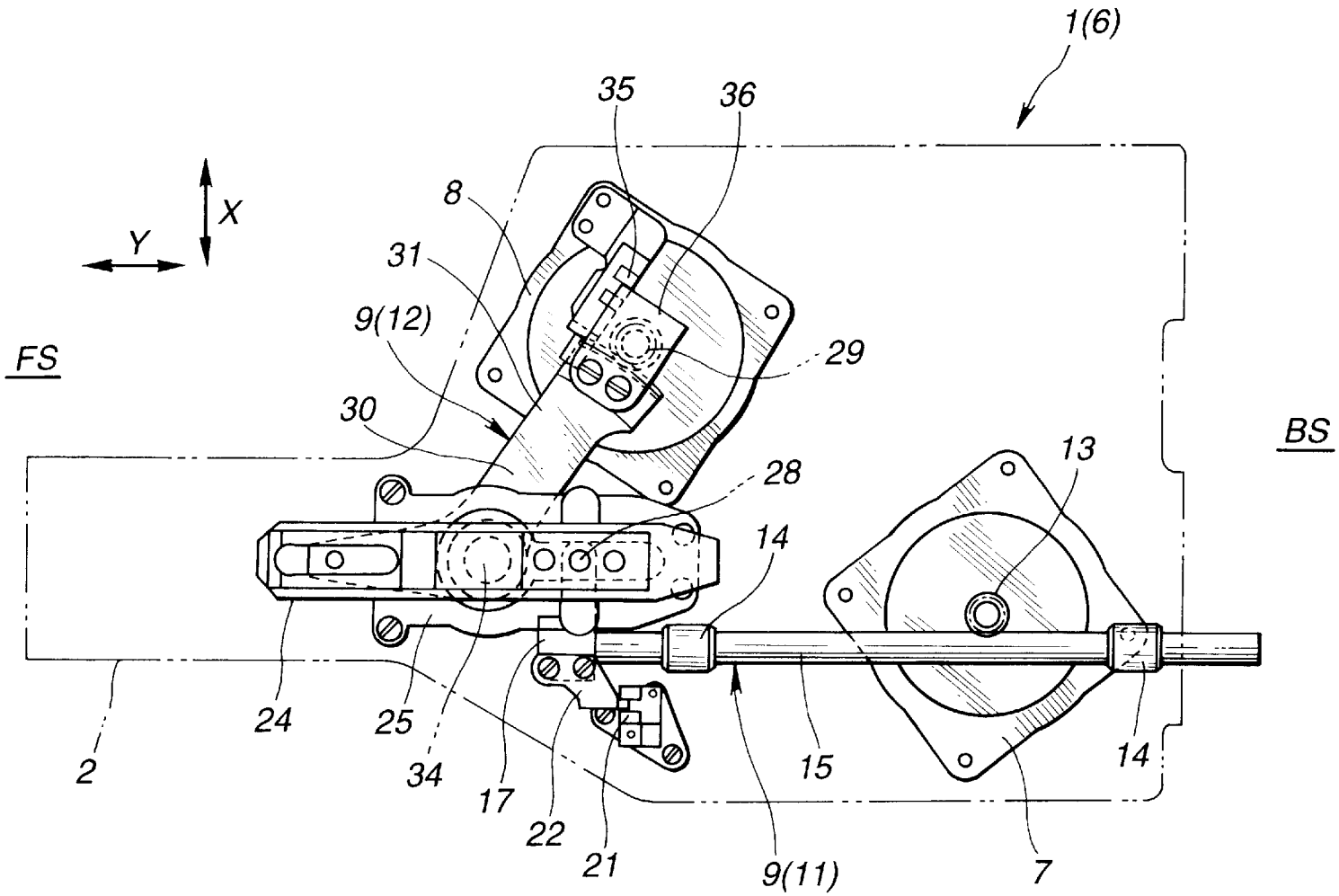
FIG. 5 is a plan of FIG. 4.
Figure 6:
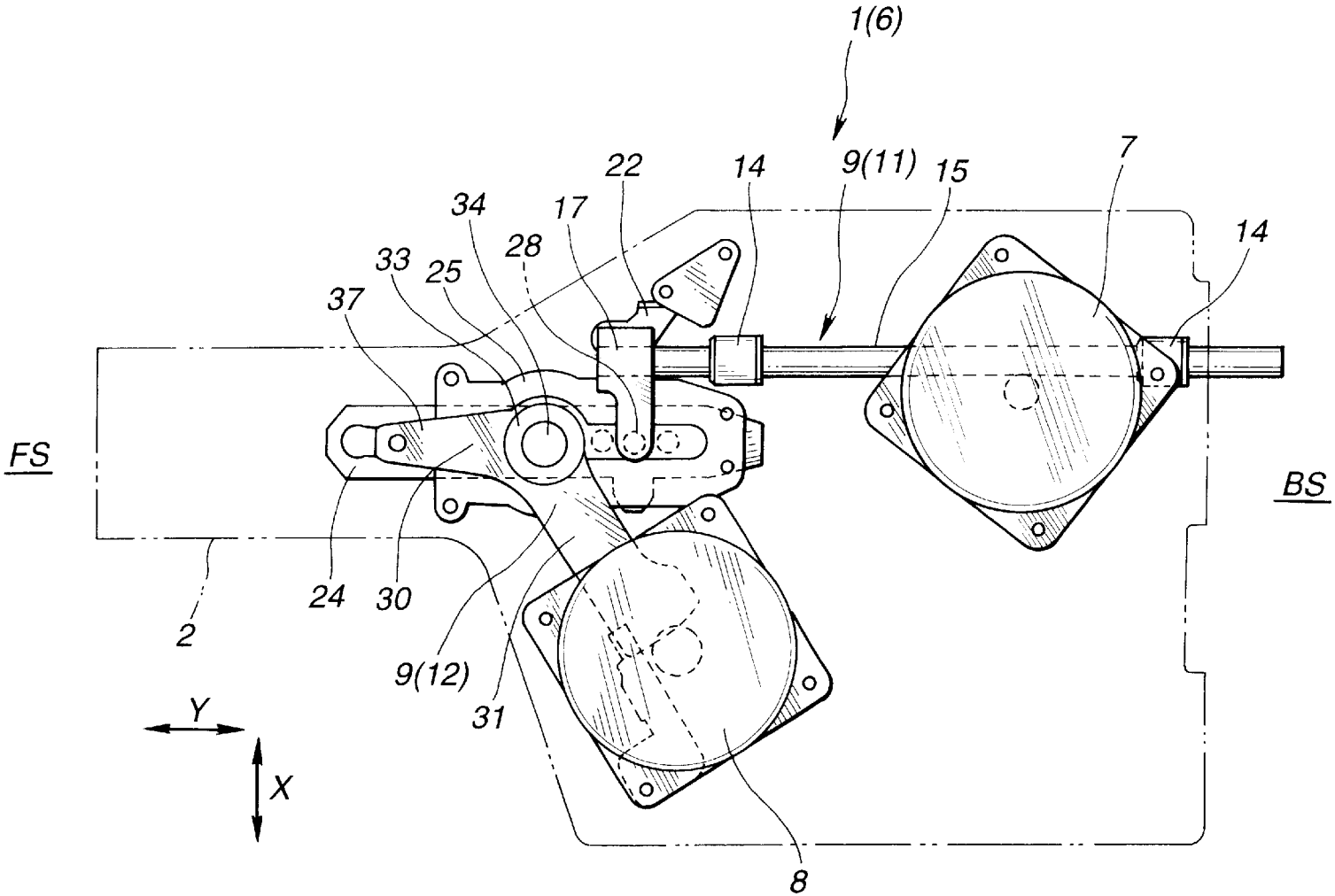
FIG. 6 is a bottom view of FIG. 4.
Figure 7:
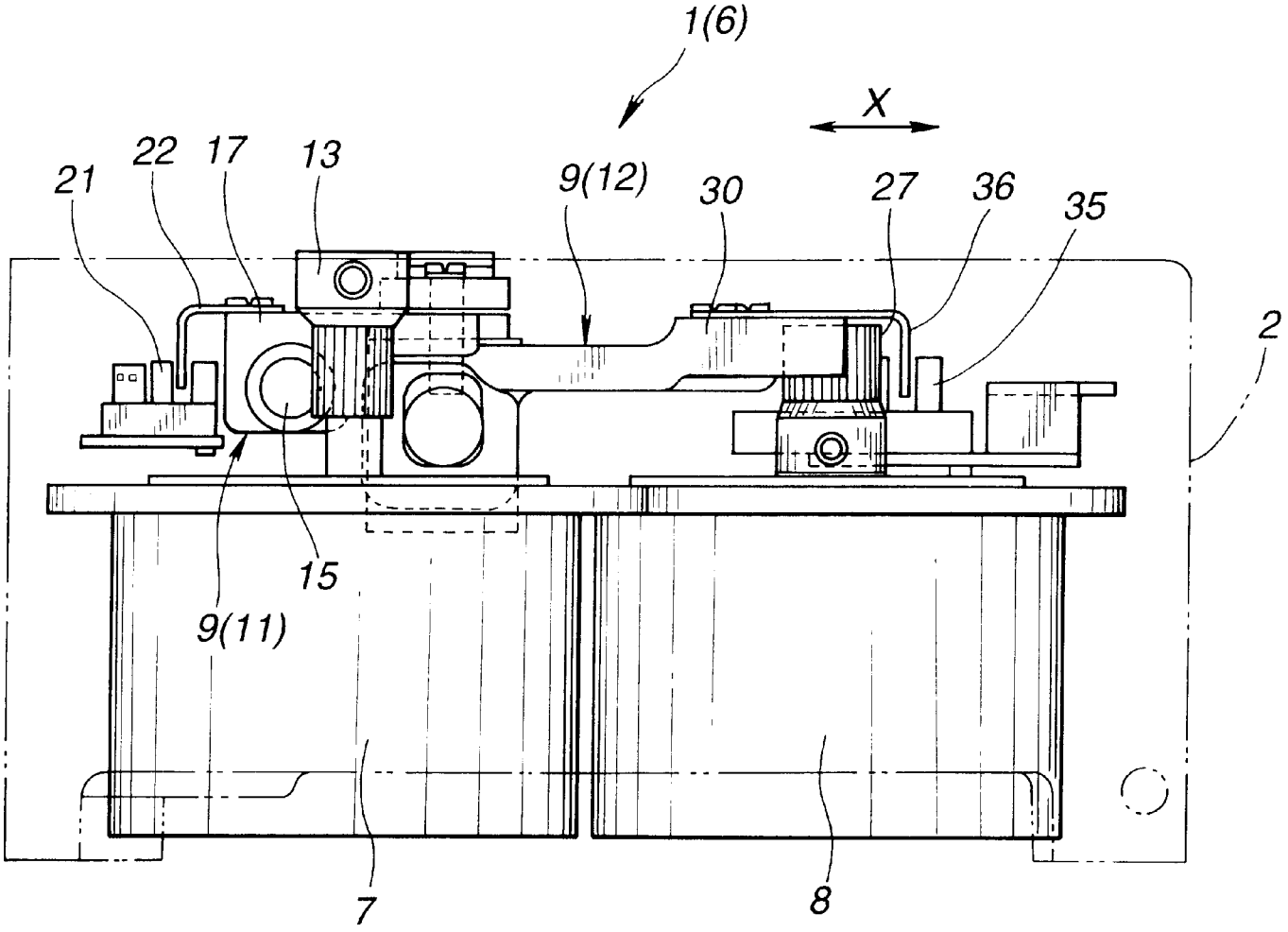
FIG. 7 is a right side view of FIG. 5.

FIGS. 1 to 7 show an embodiment of a contour sewing machine according to the present invention using a sewing movement control method according to the present invention, FIG. 1 is an outside drawing showing the main part of the whole configuration, FIG. 2 is an exploded perspective drawing showing the main part of the internal configuration of a bed, FIG. 3 is a block diagram showing the configuration of the main part, FIG. 4 is a front view showing the main part of the internal configuration of the bed, FIG. 5 is a plan when the main part of the internal configuration of the bed shown in FIG. 4 is viewed from the top, FIG. 6 is a bottom view when the main part of the internal configuration of the bed shown in FIG. 4 is viewed from the bottom and FIG. 7 is a right side view when the plan shown in FIG. 5 is viewed from the right side.

A contour sewing machine equivalent to this embodiment is formed so that sewing holding means is moved in longitudinal and transverse two directions approximately perpendicular along the surface of a bed by converting one of the driving force of a pair of driving motors to approximate linear motion and converting the other to linear motion.

As shown in FIG. 1, in the contour sewing machine 1 equivalent to this embodiment, a bed 2 is arranged in a lower part, a machine arm 3 is arranged in parallel with the bed 2 in an upper part and as a whole, the above contour sewing machine is formed approximately in the reversed shape of C when viewed from the front. In a desired position on the lower surface on the side of the free end of the machine arm 3 called the head of the machine shown left in FIG. 1, a needle bar 4 with well-known suitable length at the end of which various well-known sewing needles not shown can be attached/detached is arranged. Inside this machine arm 3, an upper shaft (not shown) driven by driving means such as a motor via transmission means not shown is supported so that the upper shaft can be rotated so as to vertically move the above needle bar 4. Generally, in such a contour sewing machine 1, the left side shown in FIG. 1 on which a user confronts the head of a machine in working is installed as the operation side, therefore, in FIG. 1, the left side is shown as the front side FS which is the operation side and the right side is shown as the back side BS reverse to the operation side.

On the upper surface of the above bed 2, a feed bar 5 as sewing holding means which can support sewing is arranged and the feed bar 5 can be moved along the surface of the bed 2 by sewing conveyance means 6 arranged inside the bed 2 and described later so that a predetermined sewing pattern can be obtained. That is, the feed bar 5 in a sewable state is constituted so that predetermined contour sewing can be executed with the feed bar holding sewing by the sewing conveyance means 6.

As shown in FIG. 2, the sewing conveyance means 6 is formed by pulse motors 7 and 8 as a pair of driving motors and also called stepping motors and driving force transmission means 9 for converting the torque of these two pulse motors 7 and 8 to force in each different direction and transmitting it to the feed bar 5.

The above each pulse motor 7 or 8 is housed (arranged under the upper surface of the bed 2) inside the bed 2 with its output shaft 7*a* or 8*a* arranged perpendicularly to the upper surface which is the surface of the bed 2 as shown by an imaginary line in FIG. 1, and these pulse motors 7 and 8 are electrically connected to control means 10 described above and shown in FIG. 3. That is, each pulse motor 7 or 8 is constituted so that it is driven according to a control command sent from the control means 10.

In this embodiment, the pulse motor 7 located on the back side BS and shown on the right side in FIGS. 1, 2 and 4 to 6 is also called r motor used for longitudinal feed for moving the feed bar 5 in a longitudinal direction (in the direction of the y-axis, that is, longitudinally). The pulse motor 8 located on the front side FS and shown on the left side in FIGS. 1, 2 and 4 to 6 is also called θ motor used for transverse feed for moving the feed bar 5 in a horizontal direction (in the direction of the x-axis, that is, transversely).

As shown in FIG. 2, the above driving force transmission means 9 is provided with linear motion conversion means 11 which can convert the torque of the pulse motor 7 for longitudinal feed shown on the right side in FIG. 2 to linear motion and reciprocation conversion means 12 which can convert the torque of the pulse motor 8 for transverse feed shown on the left side in FIG. 2 to reciprocation in a direction in which the tangent of the reciprocation is perpendicular to the linear motion.

The above linear motion conversion means 11 is provided to convert the torque of the pulse motor 7 for longitudinal feed shown on the right side in FIG. 2 to linear motion, to transmit it to the feed bar 5 and to move the feed bar 5 in a longitudinal direction shown by a bidirectional arrow Y in FIG. 2 along the surface of the bed 2 and provided with a pinion gear 13 which is a spur gear and attached to the end of the output shaft 7*a* of the pulse motor 7 for longitudinal feed. The pinion gear 13 is always engaged with a rack 16 formed on a longitudinal feed shaft 15 (shown with it divided into plural parts in FIG. 2) supported before and behind by a pair of bearings 14 arranged inside the bed 2 so that the longitudinal feed shaft can be reciprocated.

A longitudinal feed arm 17 is attached to the front end shown on the left side in FIG. 2 of the above longitudinal feed shaft 15. The longitudinal feed arm 17 is provided with a base 19 the section of which is approximately square and where a through hole 18 into which the front end of the longitudinal feed shaft 15 is fitted is formed, and an arm part 20 is extended left on the left side of the base 19. A hooked longitudinal feed sensor operating plate 22 for operating a longitudinal feed sensor 21 for detecting a home position in a longitudinal direction is attached to the upper surface of the base 19. An inclination prevention part 23 the surface of which is formed approximately square is formed on the upper surface on the free end side of the arm part 20. The inclination prevention part 23 is fitted from the bottom into a fitting groove 26 formed longitudinally in a cloth feed backing plate 25 for supporting a cloth feed plate 24 to the upper surface of which the feed bar 5 is attached from the bottom so that the cloth feed plate can be slid, and the right and left sides of the inclination prevention part 23 are formed so that they are respectively slid along the right and left sides of the fitting groove 26 formed in the cloth feed backing plate 25.

A screw hole 27 is formed in the center of the above inclination prevention part 23 and a cloth feed plate fulcrum shaft 28 is fixed to the center of the inclination prevention part 23 by fitting the lower end of the cloth feed plate fulcrum shaft 28 into the screw hole 27 helically. The upper end of the cloth feed plate fulcrum shaft 28 is fitted into a fulcrum shaft supporting hole 44 shown in FIG. 4 provided with the bottom, made through the lower surface on the back side BS of the cloth feed plate 24 and provided in a position shown as *1 in FIG. 2 so that the cloth feed plate 24 is supported from the bottom ratably.

The above reciprocation conversion means 12 is provided to convert the torque of the pulse motor 8 for transverse feed shown on the left side in FIG. 2 to reciprocation, to transmit it to the feed bar 5 and to move the feed bar 5 in a transverse direction shown by a bi-directional arrow X in FIG. 2 along the upper surface of the bed 2 and provided with a pinion gear 29 which is a spur gear and attached to the end of the output shaft 8*a* of the pulse motor 8 for transverse feed. The pinion gear 29 is always engaged with an approximately sector gear part 32 formed at the edge of the free end (in an upper part in FIG. 2) of a rear arm 31 located on the back side BS of a transverse feed arm 30 approximately formed like a bell crank. An approximately cylindrical mounting part 33 the longitudinal direction of which is extended in the direction of the thickness of the transverse feed arm 30 is formed in the bent part of the transverse feed arm 30. A transverse feed arm shaft 34 arranged through the transverse feed arm 30 in the above direction of the thickness, the lower end of which is supported inside the bed 2 and the upper end of which is a two-stage shaft with a large diameter is fitted into the mounting part 33. That is, the transverse feed arm 30 is supported by the transverse feed arm shaft 34 so that the transverse feed arm can be reciprocated.

A hooked transverse feed sensor operating plate 36 for operating a transverse feed sensor 35 for detecting the home position transversely is attached to the upper surface on the side of the free end (in the upper part in FIG. 2) of the rear arm 31 of the above transverse feed arm 30.

An approximately square piece mounting part 38 is formed at the free end (in a left part in FIG. 2) of a front arm 37 located on the front side FS of the transverse feed arm 30 and a square piece 39 is supported on the upper surface of the square piece mounting part 38 by a transverse feed piece shaft 40 the upper end of which is a two-stage shaft with a large diameter so that the square piece can be rotated.

The cloth feed backing plate 25 for supporting the above cloth feed plate 24 from the bottom so that the cloth feed plate can be slid is arranged is arranged over the above transverse feed arm 30 and a through hole 41 to which a part of the front end located on the front side FS of the above fitting groove 26 is connected is formed approximately in the center of the cloth feed backing plate 25. The through hole 41 is formed so that the upper end with a large diameter of the above transverse feed piece shaft 40 can be housed in the through hole.

The above square piece 39 is fitted into a fitting groove 42 formed longitudinally along the front side of the cloth feed plate 24 from the bottom, and the right and left sides of the square piece 39 are formed so that they are slid along the right and left sides of the fitting groove 42 formed in the cloth feed plate 24. A feed bar mounting part 43 for attaching the above feed bar 5 by fastening means such as a screw not shown is formed on the back side of the upper surface of the cloth feed plate 24.

The sewing conveyance means 6 has only to be constituted so that the driving force of each pulse motor 7 or 8 arranged inside the bed 2 can be converted to linear motion or reciprocation and transmitted to the feed bar 5, for example may be also constituted using a screw, a timing belt and others in place of the linear motion conversion means 11 in this embodiment using the rack and the pinion and particularly, sewing conveyance means according to the present invention is not limited to the constitution of the sewing conveyance means 6 in this embodiment.

A cover not shown is attached to a necessary part on the upper and lower surfaces of the bed 2 without interfering with the above each member for securing safety and others.

The above control means 10 is arranged in a desired position of the machine 1. The control means 10 is provided to control the operation of the sewing conveyance means 6 and each part of the machine I and as shown in FIG. 3, is at least provided with system ROM 45, RAM 47, CPU 48, an interface 49, a control panel 50, a pulse motor driver 51 for controlling the above each pulse motor 7 and 8, an upper shaft motor driver 53 for controlling an upper shaft servo motor 52 as a driving motor for driving an upper shaft not shown, data output means 55 composed of a floppy disk drive (hereinafter called FDD) which can read sewing data stored in a storage device 56 composed of a floppy disk (hereinafter called FD) and others or can read and write it and others, and various data such as the detection data of the home position in a longitudinal direction and in a transverse direction detected by the above longitudinal feed sensor 21 and the above transverse feed sensor 35 and upper shaft position detection data detected by an upper shaft position sensor 54 can be input to the control means via the interface 49.

For sewing data in this embodiment, a position to which the above sewing holding means 5 is moved is stored in the storage device 56 as coordinate values in the position moved from the home position at rectangular coordinates (the X-Y coordinates) in longitudinal and transverse two directions mutually perpendicular. The storage device 56 can be selected out of a well-known variety of an electrically erasable and programmable read only memory (EEPROM), a magneto-optical disc (MO), a compact disc read only memory (CDROM) and an integrated circuit (IC) card the design concept of which complies with that of the storage device 56.

A correction table for correcting the driven quantity of each driving motor 7 or 8 at least corresponding to coordinate values in the above sewing data is stored in the system ROM 45 of the control means 10 and correction table storage means 58 in this embodiment is formed by the system ROM 45. The correction table storage means 58 may be also constituted by ROM storing a correction table and independently provided.

A program for suitably controlling a position to which the feed bar 5 which is sewing holding means at least when contour sewing is executed is moved based upon values obtained based upon sewing data stored in the above storage device 56 and the correction table storing the driven quantity of each driving motor 7 or 8 corresponding to coordinate values in the sewing data and stored in the correction table storage means 58 is stored in the system ROM 45 of the control means 10. That is, as an error such as the feed bar 5 is moved in a circular arc by the reciprocation conversion means 12 and a sewed area is extended is increased and a sewing pattern transversely linear cannot be obtained if the transverse movement is executed only by the reciprocation of the transverse feed arm 30, the transverse movement curved (in the circular arc) with the cloth feed plate fulcrum shaft 28 of the feed bar 5 in the center by the pulse motor 8 for transverse feed can be corrected so that the sewing pattern transversely linear is obtained.

It is desirable that if the above sewing data is given as quantity in which the sewing holding means 5 is moved, a program for converting the above quantity to coordinate values in the moved position is stored in the system ROM 45 of the control means 10 as data conversion means not shown.

Various programs required for sewing operation such as a program for operating thread cutting means not shown for cutting thread after contour sewing is executed are also stored in the system ROM 45 of the control means 10.

Further, a program for inputting data such as sewing data may be also stored in the system ROM 45 of the control means 10 if necessary for its design concept and others.

Next, the action of this embodiment composed as described above will be described.

In the contour sewing machine 1 equivalent to this embodiment, the feed bar 5 can be moved along the surface of the bed by driving each pulse motor 7 or 8 so that predetermined contour sewing is executed.

First, when the pulse motor 7 for longitudinal feed is driven according to a control command sent from the control means 10, the pinion gear 13 attached to the end of its output shaft 7*a* is rotated and the longitudinal feed shaft 15 is moved longitudinally via the rack 16 engaged with the pinion gear 13 as shown by the bidirectional arrow in FIG. 2. As the longitudinal feed shaft 15 is moved longitudinally, the longitudinal feed arm 17 attached to the front end of the longitudinal feed shaft 15 is also moved longitudinally and the cloth feed plate fulcrum shaft 28 arranged in the center of the inclination prevention part 23 of the longitudinal feed arm 17 is also moved longitudinally. As the cloth feed plate fulcrum shaft 28 is moved longitudinally, the cloth feed plate 24 is moved longitudinally and the feed bar 5 attached to the cloth feed plate 24 can be moved longitudinally.

As the driving force of the pulse motor 7 is transmitted to the longitudinal feed shaft 15 using the pinion gear 13 and the rack 16, backlash can be readily prevented and as a result, the precision of longitudinal feed can be readily enhanced.

Further, as the right and left sides of the inclination prevention part 23 formed on the upper surface on the side of the free end of the arm part 20 of the longitudinal feed arm 17 are respectively slid along the right and left sides of the fitting groove 26 formed in the cloth feed backing plate 25 when the longitudinal feed arm 17 is moved longitudinally, the longitudinal feed arm 17 can be securely prevented from being rotated with the longitudinal feed shaft 15 in the center and inclined, and as a result, a state in which the pinion gear 13 and the rack 16 are engaged can be always securely held in a suitable position in long term.

When the pulse motor 8 for transverse feed is driven according to a control command sent from the control means 10, the pinion gear 29 attached to the end of its output shaft 8*a* is rotated and the transverse feed arm 30 is reciprocated transversely as shown by the bidirectional arrow with the transverse feed arm shaft 34 in the center via the gear part 32 formed at the free end of the rear arm 31 of the transverse feed arm 30 engaged with the pinion gear 29. As the transverse feed arm 30 is reciprocated transversely, the cloth feed plate 24 connected via the square piece 39 is moved transversely with the above cloth feed plate fulcrum shaft 28 in the center. At this time, as the right and left sides of the square piece 39 are rotated, being slid along the right and left sides of the fitting groove 42 formed in the cloth feed plate 24 as the transverse feed arm 30 is reciprocated because the square piece 39 is arranged rotatably with the transverse feed piece shaft 40 in the center, the reciprocation of the transverse feed arm 30 is smoothly transmitted to the cloth feed plate 24 and the feed bar 5 attached to the cloth feed plate 24 can be moved transversely.

When the feed bar 5 is moved transversely, the pulse motor 7 is driven by the control means 10 and correction to obtain a precise sewing pattern is executed.

Therefore, according to the contour sewing machine 1 equivalent to this embodiment, as the sewing conveyance means 6 can convert the driving force of each pulse motor 7 or 8 to linear motion or reciprocation by the linear motion conversion means 11 or the reciprocation conversion means respectively constituting the driving force transmission means 9 and can transmit it to the feed bar 5, the feed bar 5 can be securely moved along the surface of the bed 2 so that a predetermined sewing pattern is obtained.

That is, the sewing conveyance means 6 of the contour sewing machine 1 equivalent to this embodiment is constituted so that the respective driving force of both pulse motors 7 and 8 is converted to linear motion and reciprocation by the linear motion conversion means 11 and the reciprocation conversion means, afterward, the linear motion and the reciprocation are synthesized and transmitted to the feed bar 5.

Next, referring to FIGS. 8 and 9, correction executed by the control means 10 of the contour sewing machine 1 equivalent to this embodiment will be described.

Figure 8:
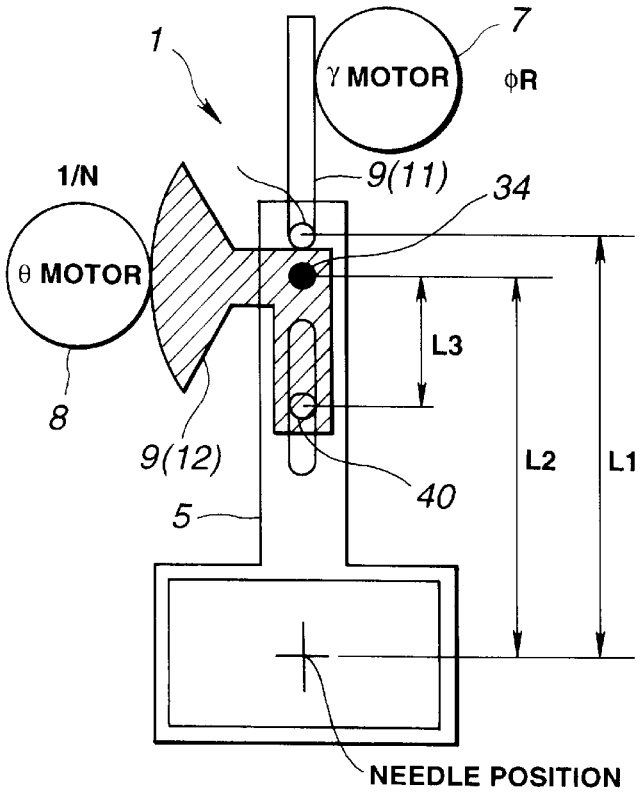
FIG. 8 is a schematic drawing showing the a movement mechanism of sewing holding means in the embodiment of the contour sewing machine according to the present invention using a sewing movement control method according to the present invention.

FIG. 8 is a schematic drawing showing a mechanism for moving sewing holding means in the embodiment of the contour sewing machine according to the present invention using the sewing movement control method according to the present invention shown in FIGS. 1 to 7 and FIG. 9 is an explanatory drawing showing relationship between sewing data and correction values.

The conversion of coordinates (x, y) [mm] in sewing data stored in the above storage device 56 to pulses (tp, rp) from the home position of each driving motor 7 or 8 is calculated according to the following expression.

$$r = L1 - \sqrt{(L1 - y)^2 + x^2} \quad \text{[mm]}$$

$$t = \tan^{-1}\left(\frac{x}{L1 - y}\right) + \sin^{-1}\left(\frac{\sin\left(\tan^{-1}\left(\frac{x}{L1 - y}\right)\right)}{L3} \times (L1 - L2 - r)\right) \quad \text{[radian]}$$

However, as shown n FIG. 8, L1 denotes distance from a connection between the linear motion conversion means 11 and the feed bar 5 to the position of a needle, L2 denotes distance from a reciprocating fulcrum of the reciprocation conversion means 12 to the position of a needle and L3 denotes distance from a reciprocating fulcrum of the reciprocation conversion means 12 to a connection between the reciprocation conversion means 12 and the feed bar 5. "r" denotes moved distance [mm] when the feed bar 5 is moved (fed longitudinally) in the direction shown by the arrow Y by one pulse motor (r motor) 7 and "t" denotes a turning angle [radian] when the feed bar 5 is moved (fed transversely) in the direction shown by the arrow X by the other pulse motor (θ motor) 8.

The number (rp) of pulses which is equivalent to the driven quantity of the pulse motor (r motor) 7 for moving the feed bar 5 by r [mm] and t [radian] and the number (tp) of pulses which is equivalent to the driven quantity of the other pulse motor (θ motor) 8 based upon the resolution of each pulse motor 7 or 8 are calculated according to the following expression.

$$TC = \frac{2 \times x}{\frac{N}{800}} \quad \text{[radian/pulse]}$$

$$RC = \frac{R \times x}{400} \quad \text{[mm/pulse]}$$

$$tp = \frac{t}{TC} \quad \text{[pulse]}$$

$$rp = \frac{r}{RC} \quad \text{[pulse]}$$

However, R denotes the diameter of a pitch circle between the pulse motor (r motor) 7 and the linear motion conversion means 11 and N denotes a turnover rate between the pulse motor (θ motor) 8 and the reciprocation conversion means 12. The resolution of one pulse motor (r motor) 7 is set to 400 and the resolution of the other pulse motor (θ motor) 8 is set to 800.

The respective values of the above L1, L2, L3 and R and N are determined based upon a design concept and others and there are an example of L1=195 mm, L2=192 mm, L3=80 mm, R=12.8 mm and N=15 and an example of L1=108 mm, L2=175 mm, L3=53 mm, R=12.8 mm and N=10.

The number (rp, tp) of pulses which is equivalent to the driven quantity of each pulse motor 7 or 8 based upon sewing data composed of coordinate values (x, y) from the home position at the X-Y coordinates can be calculated according to the above expressions.

In this embodiment, the value of the number of pulses of each pulse motor 7 or 8 beforehand calculated for the X-Y coordinates in a sewing area according to the above expressions is stored as a correction value in the system ROM 45 of the control means 10 in the form of a correction table, and when coordinate values (x, y) in sewing data when contour sewing is executed are converted to the number of pulses which is equivalent to the driven quantity of each pulse motor 7 or 8, suitable contour sewing can be securely and readily executed by using a correction value stored in the correction table and processing time can be reduced, compared with a case that the number of pulses are calculated according to the above expressions by CPU 48 used in the contour sewing machine 1.

As described above, sewing data can be shared independent of difference in a method of moving the feed bar 5 as sewing holding means between a pair of driving motors 7 and 8. That is, the existing sewing data when the sewing holding means not shown is moved at the X-Y coordinates can be shared as sewing data in case the feed bar 5 as the sewing holding means is moved in a circular arc. Further, as sewing data in the correction table can be readily corrected and the suitable moved position of the feed bar 5 can be securely obtained independent of a case that the feed bar 5 is moved in a circular arc, the enlargement or reduction of a contour when the feed bar 5 is moved in a circular arc, the difference in size of a sewing area when the feed bar 5 is moved in a circular arc and others, a contour can be readily and securely prevented from being distorted in case the feed bar 5 is moved in a circular arc and contour sewing is executed.

Sewing data can be stored in a form in which the actual moved quantity of the feed bar 5 is increased. For example, as shown in FIG. 9, coordinate values at the X-Y coordinates can be expressed by resolution in units of 0.1 mm with the center in FIG. 9 as an origin (0, 0). In this case, a position to which the feed bar 5 is moved for the position of a lowered needle may be at any intersection on a lattice shown in FIG. 9. At this time, the number of stored correction values can be reduced and the storage capacity of the correction table storage means 58 for storing a correction table can be reduced by applying the above correction value to the X-Y coordinates by resolution in units of 1.0 mm, that is, thinning out so that a correction value is applied only to coordinate values at a fixed interval at the X-Y coordinates as shown by ● in FIG. 9 without applying the above correction value to any intersection on the lattice shown in FIG. 9.

If the number of pulses equivalent to the driven quantity of the pulse motor (θ motor) 8 is tp, the X coordinate value is xp, the number of pulses equivalent to the driven quantity of the pulse motor (r motor) 7 is rp and the Y coordinate value is yp, the above correction value is obtained as difference between the number of pulses and coordinate values as follows.

$$xc=tp-xp$$

$$yc=rp-yp$$

Figure 9:
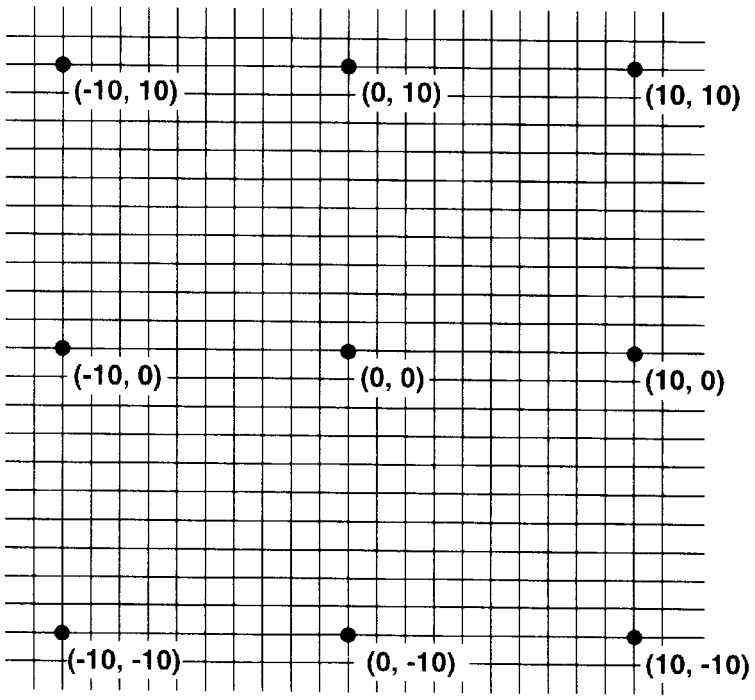
FIG. 9 is an explanatory drawing showing relationship between sewing data and a correction value.

Coordinates values (10, 10) shown by ● in FIG. 9 shows that as resolution is expressed in units of 0.1 mm at the X-Y coordinates, the actual moved position from the home position of the feed bar 5 is 1 mm in the direction of X and 1 mm in the direction of Y off the origin.

Next, referring to FIGS. 10 and 11, a method of calculating a correction value if the correction value is not found at the X-Y coordinates in sewing data will be described.

Figure 10:
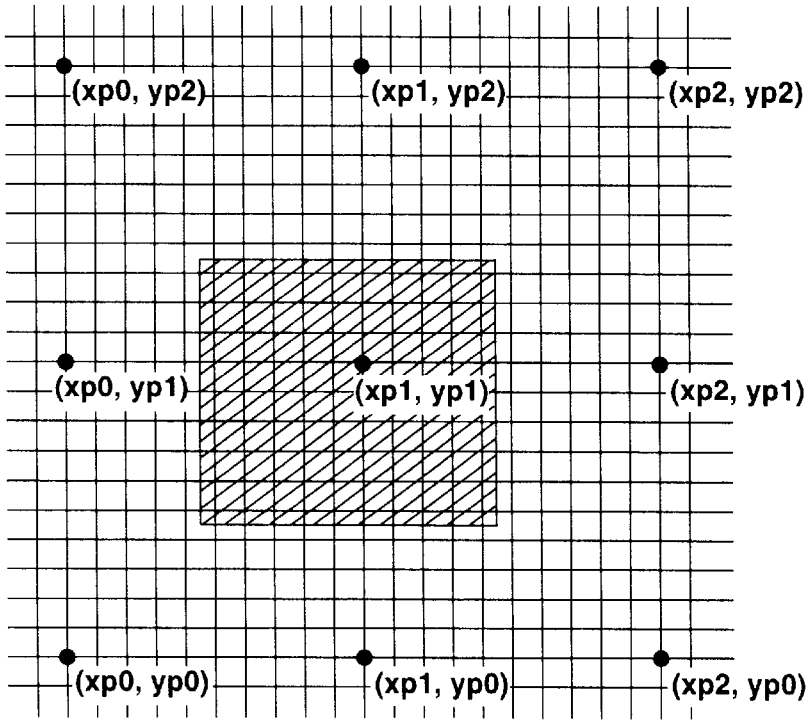
FIG. 10 is an explanatory drawing showing an example of a method of calculating a correction value in case the correction value is not found at the X-Y coordinates in the sewing data.
Figure 11:
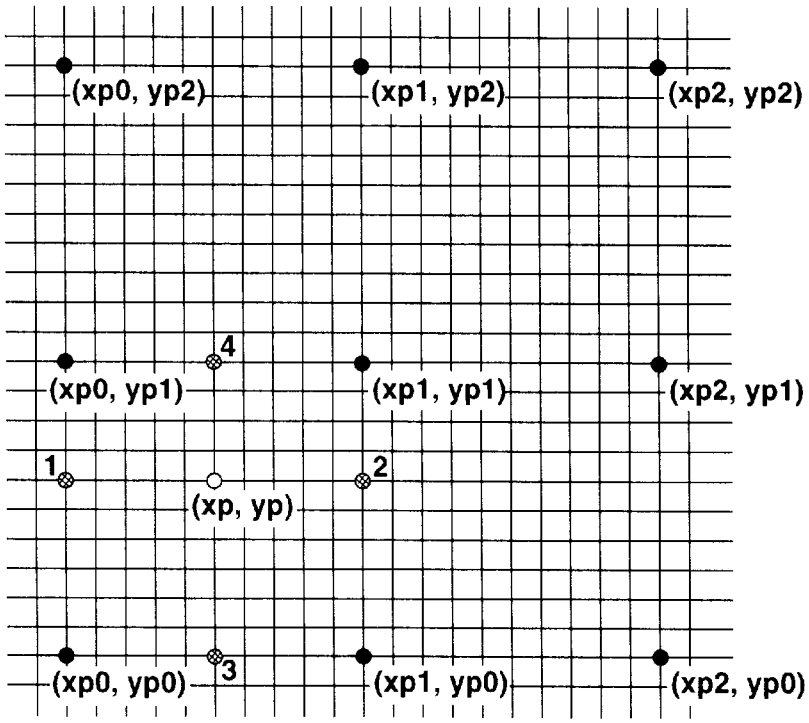
FIG. 11 is an explanatory drawing showing another example of a method of calculating a correction value in case the correction value is not found at the X-Y coordinates in the sewing data.

FIG. 10 is an explanatory drawing showing one example of a method of calculating a correction value if the correction value is not found at the X-Y coordinates in sewing data and FIG. 11 is an explanatory drawing showing another example of a method of calculating a correction value if the correction value is not found at the X-Y coordinates in the sewing data.

Correction values in the above correction table are given only to coordinate values at a fixed interval at the X-Y coordinates in sewing data and no correction value may be given to coordinate values in the moved position from the home position of the feed bar 5 in sewing data. A correction value in this case is obtained by the following two methods.

For a first method of calculating a correction value, a correction value for coordinate values in the correction table the nearest to coordinate values in the moved position from the home position of the feed bar 5 as sewing holding means is used for a correction value for coordinate values in the moved position from the home position of the feed bar 5.

That is, a correction value (xp1, yp1) to which the correction value is given is used for a correction value for coordinate values (xp, yp) on an intersection located in an area (xp1−5, yp1−5) to (xp1+4, yp1+4) shown by a frame in which oblique lines are drawn in FIG. 10 and if a correction value for (xp1, yp1) is (xc11, yc11), the number of pulses rp and tp which is respectively equivalent to the driven quantity of each pulse motor 7 and 8 is as follows.

$$tp=xp+xc11$$

$$rp=yp+yc11$$

For a second method of calculating a correction value, each correction value for coordinate values in the correction table at four points the nearest to coordinate values in the moved position from the home position of the feed bar 5 as sewing holding means is complementarily calculated based upon the coordinate values at the four points in the correction table and coordinate values in the moved position from the home position of the feed bar 5 and a value calculated in the complementary calculation is used for a correction value for coordinate values in the moved position from the home position of the feed bar 5. That is, for a correction value for coordinate values (xp, yp) in sewing data shown by ○ in FIG. 11, if in sewing data provided with coordinate values shown by ● in FIG. 11, a correction value for coordinate values (xp0, yp0) is (xc00, yc00), a correction at coordinate values (xp1, yp0) is (xc10, yc10), a correction value for coordinate values (xp0, yp1) is (xc01, yc01) and a correction value for coordinate values (xp1, yp1) is (xc11, yc11), first, to obtain an X correction value for a coordinate value xp, an X correction value for a point surrounded by a meshed circle and shown by a number 1 in FIG. 11 is complemented based upon respective X correction values for coordinate values (xp0, yp1) and coordinate values (xp0, yp0) as follows.

$$xc1=(xc01-xc00)\times(yp-yp0)/10+xc00$$

Next, an X correction value for a point surrounded by a meshed circle and shown by a number 2 in FIG. 11 is complemented based upon respective X correction values for coordinate values (xp1, yp1) and coordinate values (xp1, yp0) as follows.

$$xc2=(xc11-xc10)\times(yp-yp0)10+xc00$$

Next, an X correction value for coordinate values (xp, yp) is complemented based upon X correction values respectively complemented at the point shown by the number 2 in FIG. 11 and at the point shown by the number 1 in FIG. 11 as follows $$xc=(xc2-xc1)\times(xp-xp0)/10+xc1$$

and the number tp of pulses equivalent to the driven quantity of the pulse motor 8 is as follows.

$$tp=xp+xc$$

To obtain a Y correction value for a coordinate value yp, first, a Y correction value for a point surrounded by a meshed circle and shown by a number 3 in FIG. 11 is complemented based upon respective Y correction values for coordinate values (xp 1, yp0) and coordinate values (xp0, yp0) as follows.

$$yc3=(yc10-yc00)\times(xp-xp0)/10+yc00$$

Next, a Y correction value for a point surrounded by a meshed circle and shown by a number 4 in FIG. 11 is complemented based upon respective Y correction values for coordinate values (xp1, yp1) and coordinate values (xp0, yp1) as follows.

$$yc4=(yc11-yc01)\times(xp-xp0)/10+yc01$$

Next, a Y correction value for coordinate values (xp, yp) is complemented based upon Y correction values respectively complemented at the point shown by the number 4 in FIG. 11 and at the point shown by the number 3 in FIG. 11 as follows $$yc=(yc4-yc3)\times(yp-yp0)/10+yc3$$

and the number rp of pulses equivalent to the driven quantity of the pulse motor 7 is as follows.

$$rp=yp+yc$$

As described above, in this embodiment, even if a correction value is not found in the correction table, a suitable correction value can be readily obtained and as a result, predetermined contour sewing can be suitably and readily executed using the correction table having only small quantity of data.

For example, the correction table in case a sewing area (mm) ranges from (−50.0, −30.0) to (50.0, 30.0) ranges (−51.0, −31.0) to (51.0, 31.0). FIG. 12 shows an example of the configuration of the correction table in this case. If resolution at coordinate values in sewing data is increased by ten times, coordinate values in the sewing data are ten times as large as those in a sewed position. The number tp of pulses equivalent to the driven quantity of the pulse motor 8 in case an X correction value is −123 in FIG. 12 is −633 and the number rp of pulses equivalent to the driven quantity of the pulse motor 7 in case a Y correction value is −55 in FIG. 12 is −365.

It is desirable that the above first method of calculating a correction value and the second method of calculating a correction value are selected depending upon a design concept such as the first method is used if a sewing area is small and the second method is used if the sewing area is large.

As described above, according to the contour sewing machine 1 equivalent to this embodiment using the sewing movement control method equivalent to this embodiment, sewing data can be shared independent of difference between methods (XY driving and driving in a circular arc) of moving the feed bar 5 as sewing holding means by a pair of driving motors 7 and 8. That is, sewing data when the existing sewing holding means not shown is moved in the directions of X and Y can be shared as sewing data in case the feed bar 5 is moved in a circular arc in this embodiment. Further, as sewing data is readily corrected and the suitable moved position of the feed bar 5 can be obtained independent of a case that the feed bar 5 is moved in a circular arc, the enlargement or reduction of a contour when the feed bar 5 is moved in a circular arc, difference in size between sewing areas when the feed bar 5 is moved in a circular arc and others, the distortion of a contour in case the feed bar 5 is moved in a circular arc and contour sewing is executed can be readily and securely prevented and as a result, predetermined contour sewing can be suitably and securely executed.

As sewing data can be shared, an input device required to generate the sewing data is not required to be provided every machine. That is, sewing data can be also generated by a personal computer and others.

Further, data conversion means can readily convert the moved quantity from the home position of the feed bar 5 in sewing data to coordinate values in the moved position.

In a correction table in which a correction value is given only to coordinate values at a fixed interval at rectangular coordinates, the quantity of data can be reduced and as a result, the storage capacity of a memory for storing the correction table can be reduced.

Next, referring to FIGS. 13 to 20, an example of data input using the contour sewing machine 1 will be described.

Figure 13:
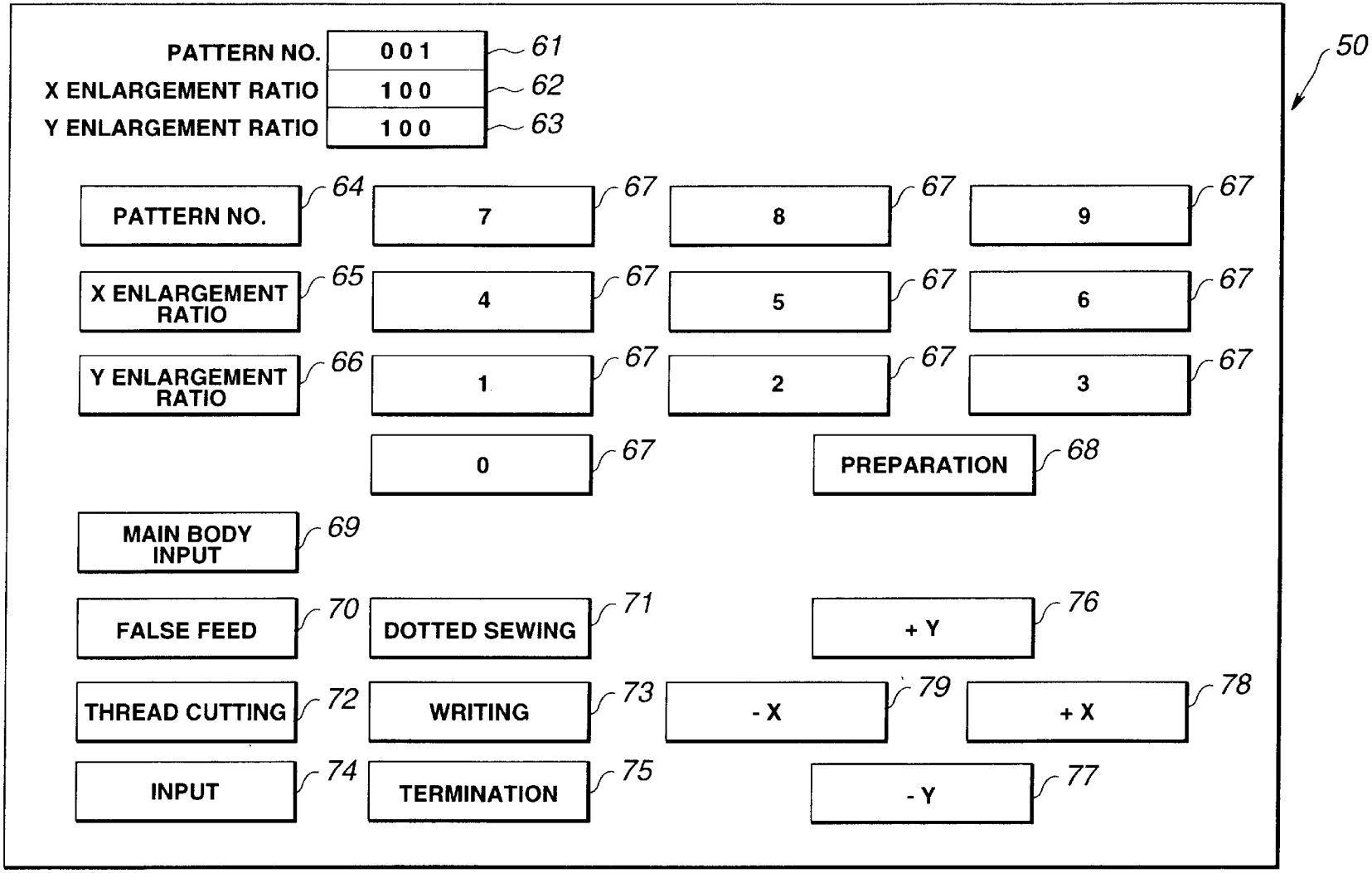
FIG. 13 is an explanatory drawing showing an example of the main part of a control panel of a contour sewing machine to which data can be input.
Figure 14:
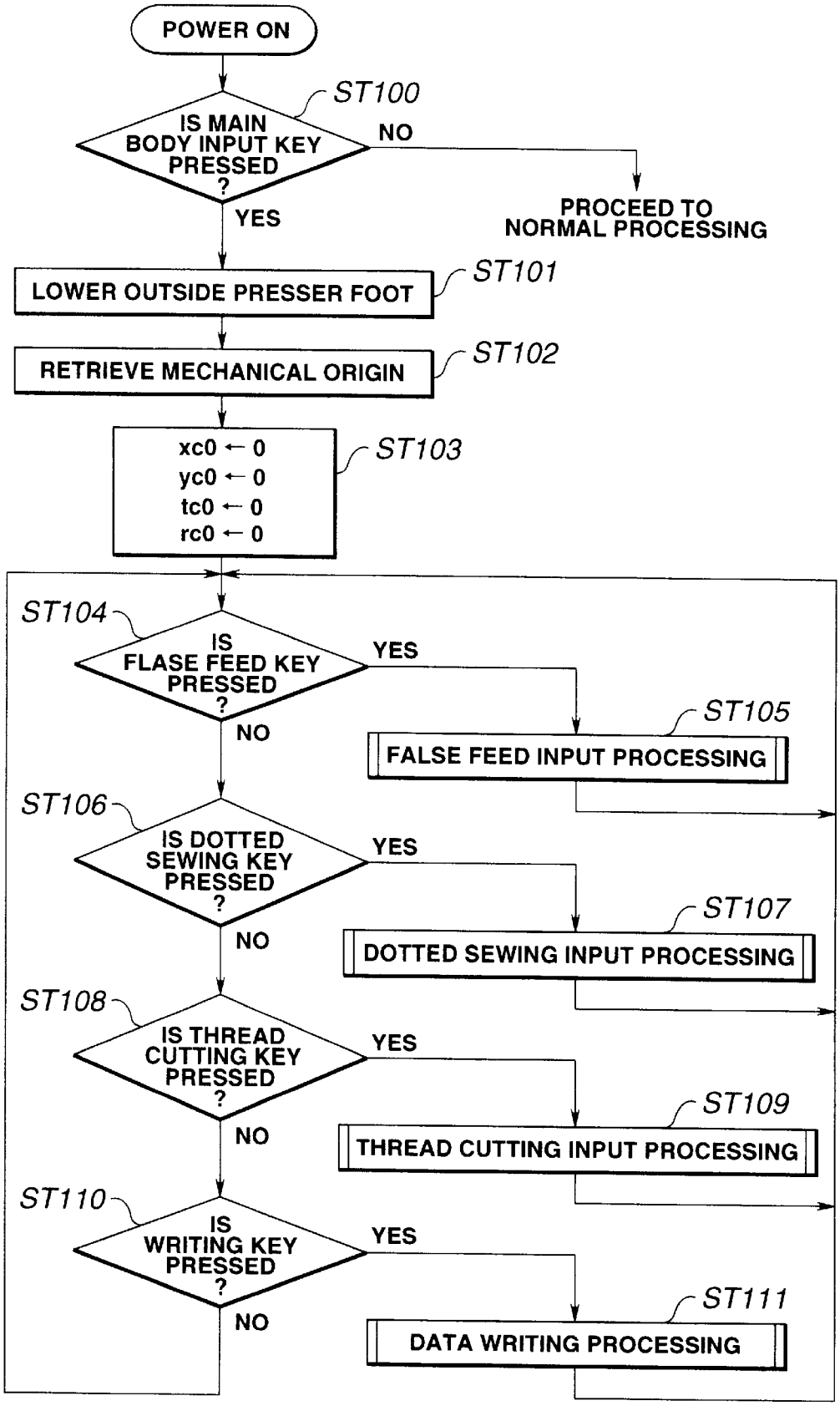
FIG. 14 is a flowchart for explaining the whole data input.
Figure 15:
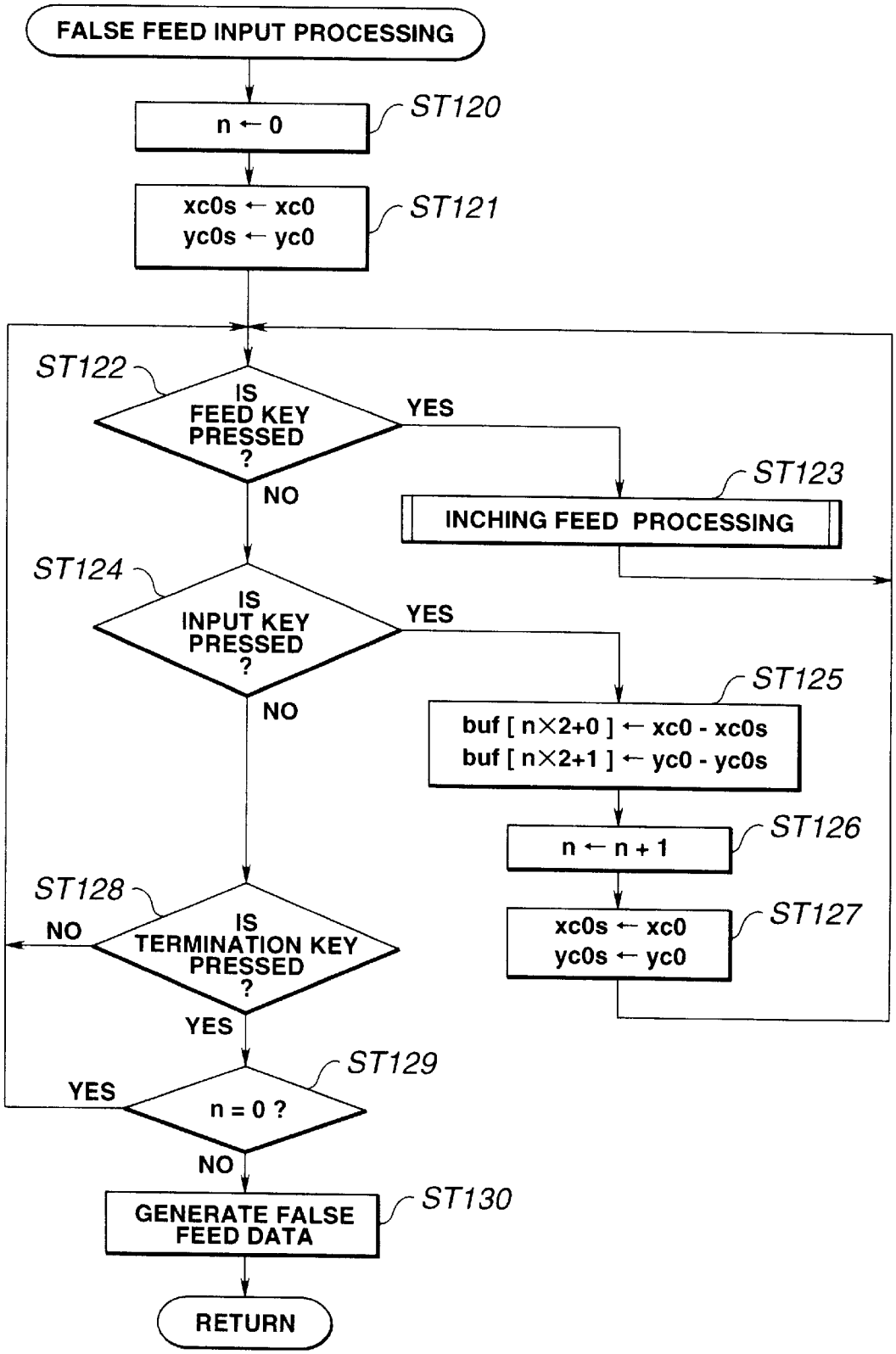
FIG. 15 is a flowchart for explaining false feed input processing.
Figure 16:
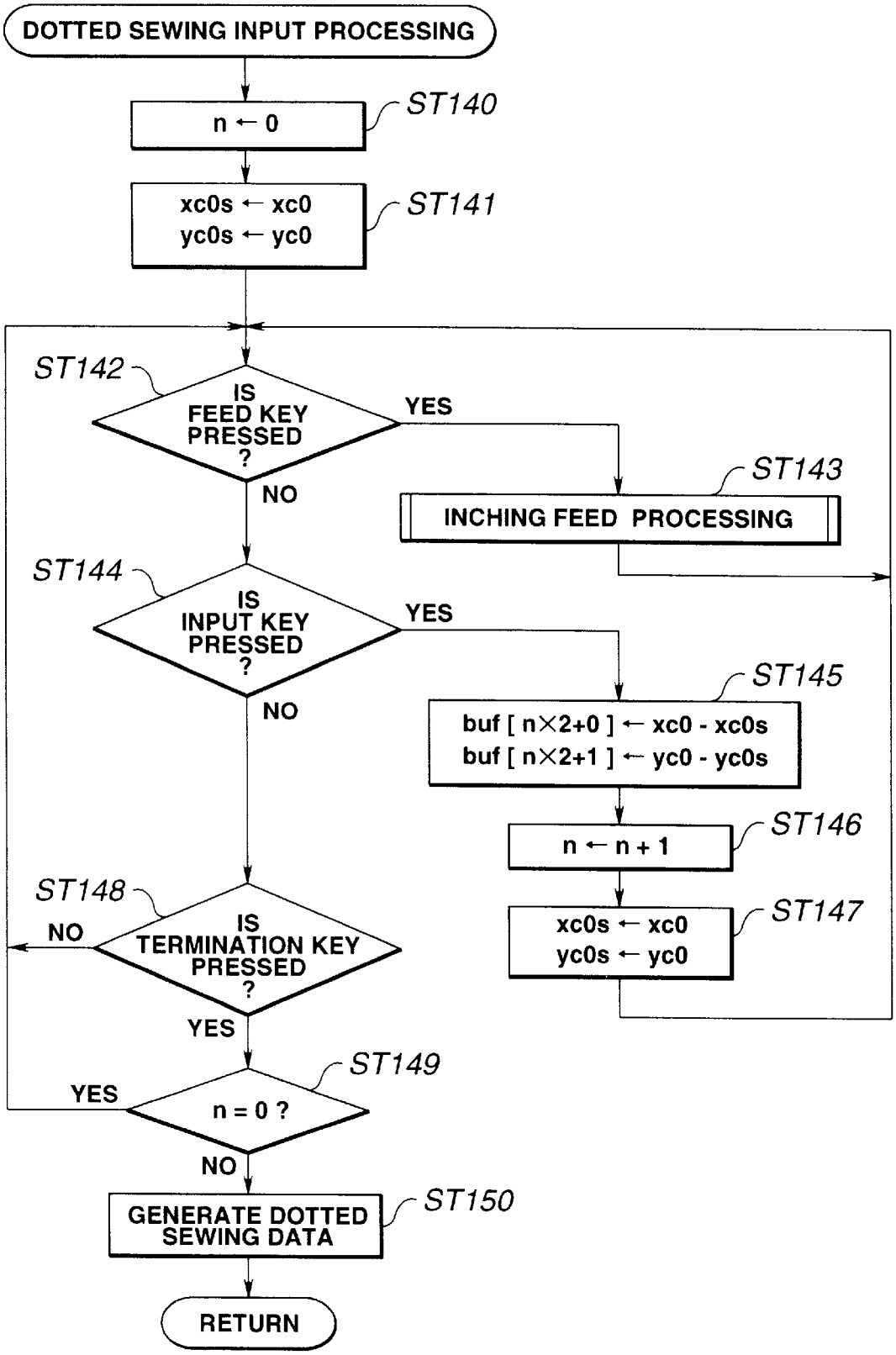
FIG. 16 is a flowchart for explaining dotted sewing input processing.
Figure 17:
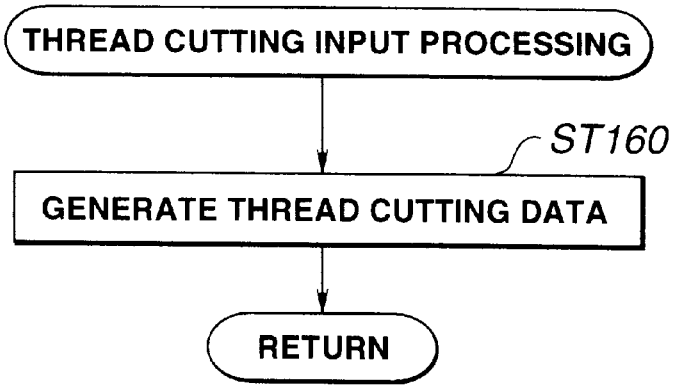
FIG. 17 is a flowchart for explaining thread cutting input processing.
Figure 18:
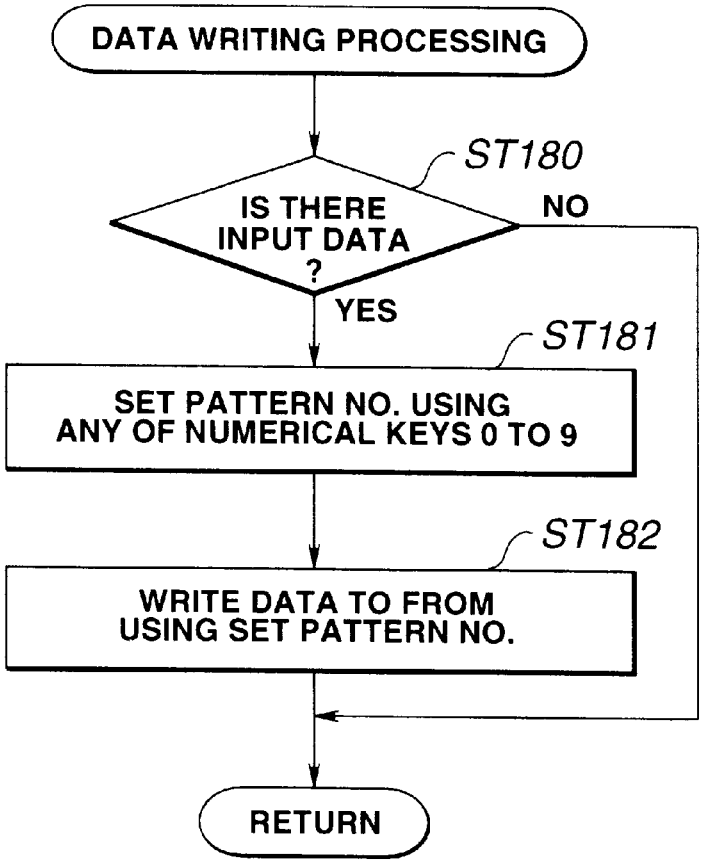
FIG. 18 is a flowchart for explaining data writing processing.
Figure 19:
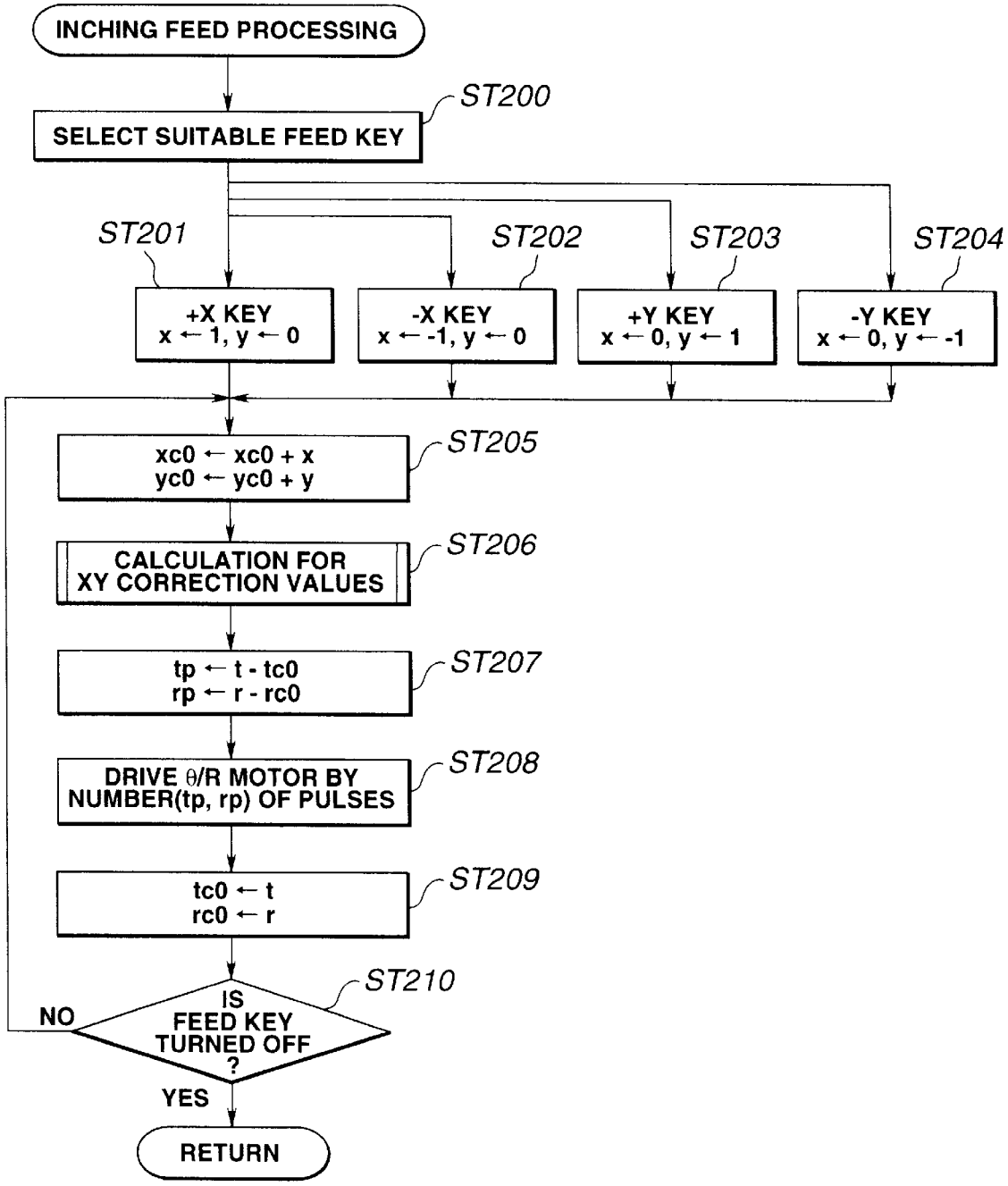
FIG. 19 is a flowchart for explaining inching feed processing.
Figure 20:
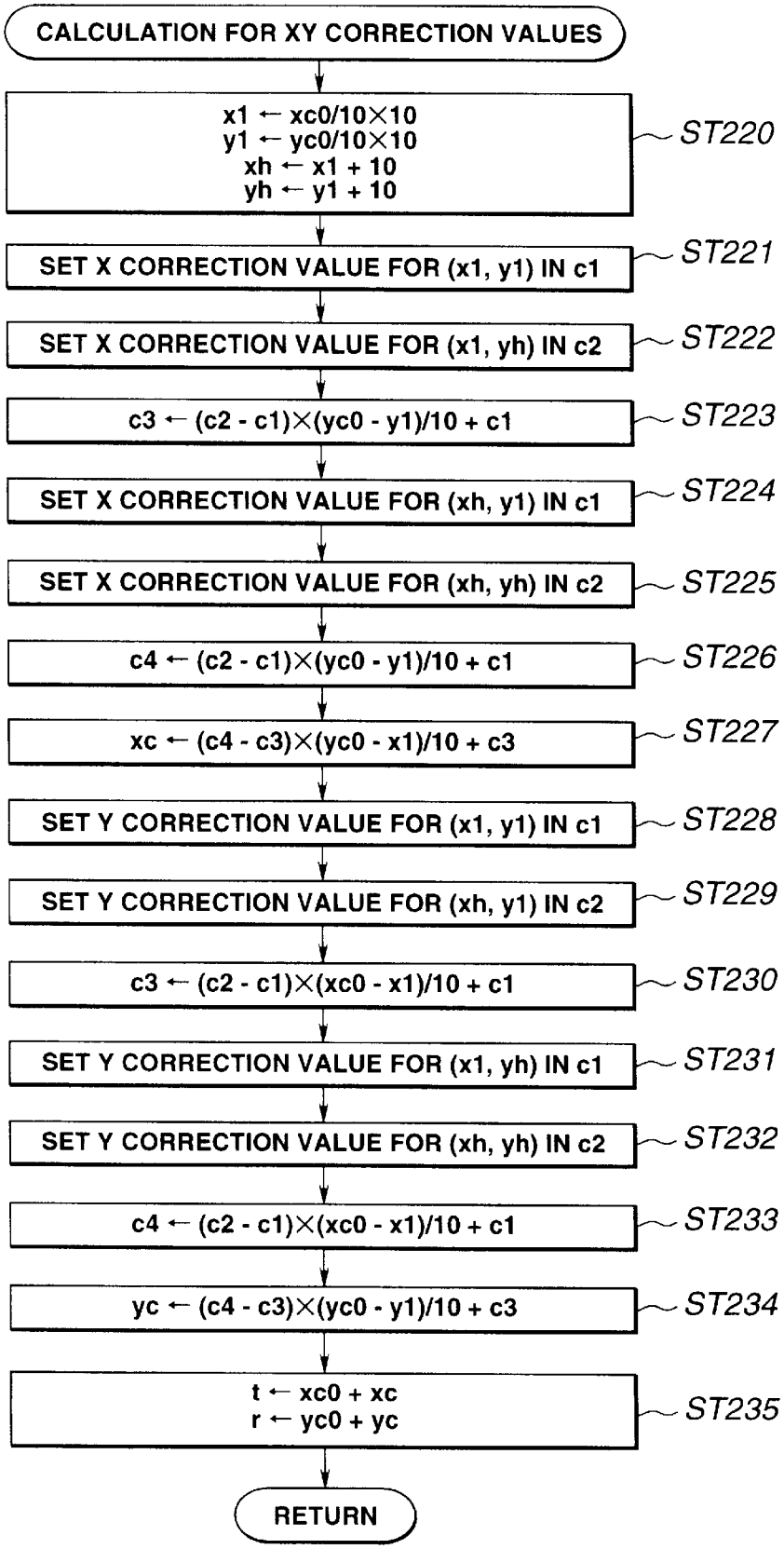
FIG. 20 is a flowchart for explaining calculation for XY correction values.

FIG. 13 is an explanatory drawing showing an example of the main part of a control panel to which data can be input of the contour sewing machine, FIG. 14 is a flowchart for explaining the whole data input, FIG. 15 is a flowchart for explaining false feed input processing, FIG. 16 is a flowchart for explaining dotted sewing input processing, FIG. 17 is a flowchart for explaining thread cutting input processing, FIG. 18 is a flowchart for explaining data writing processing, FIG. 19 is a flowchart for explaining inching feed processing and FIG. 20 is a flowchart for explaining XY calculation for correction.

As shown in FIG. 13, on the control panel 50 of the contour sewing machine 1 to which data can be input, a pattern No. display part 61 for displaying pattern No., an X enlargement ratio display part 62 for displaying enlargement ratio in the direction of X and a Y enlargement ratio display part 63 for displaying enlargement ratio in the direction of Y are sequentially arranged. Under the above display parts 61, 62 and 63, a pattern No. key 64, an X enlargement ratio key 65, a Y enlargement ratio key 66, ten numerical value input keys 67 for inputting numerical values 0 to 9, a preparation key 68, a main body input key 69, a false feed key 70, a dotted sewing key 71, a thread cutting key 72, a writing key 73, an input key 74, a termination key 75, +Y key 76, −Y key 77, +X key 78, −X key 79 and others are arranged.

When data is input, as shown in FIG. 14, first, it is judged in a step ST100 whether a power source is turned on, pressing the main body input key 69 or not and if the judgment in the step ST100 is No (only if the power source is turned on), normal processing (normal operation) is executed.

If the judgment in the step ST100 is Yes, an outside presser foot not shown is lowered in a step ST101, the pulse motors 7 and 8 are driven in a step ST102 and a mechanical origin is retrieved, and the current X-Y coordinate values (xc0, yc0) and the current number of pulses (tc0, rc0) of each pulse motor 7 and 8 are initialized in a step ST103. When the outside presser foot is lowered, it should be lowered in a state in which a sewing pattern chart such as a paper pattern in which a contour is recorded for executing predetermined contour sewing is set. The detailed description of the retrieval of the mechanical origin is omitted.

Next, in a step ST104, it is judged whether the false feed key 70 is pressed or not and if the judgment in the step ST104 is Yes, false feed input processing is called in a step ST105 and control is returned to the step ST104.

If the judgment in the step ST100 is No, processing proceeds to a next step ST106, it is judged in the step ST106 whether the dotted sewing key 71 is pressed or not, if the judgment in the step ST106 is Yes, dotted sewing input processing is called in a step ST107 and control is returned to the step ST104.

If the judgment in the step ST106 is No, processing proceeds to a next step ST108, it is judged in the step ST108 whether the thread cutting key 72 is pressed or not, if the judgment in the step ST108 is Yes, thread cutting input processing is called in a step ST109 and control is returned to the step ST104.

If the judgment in the step ST108 is No, processing proceeds to a next step ST110, it is judged in the step ST110 whether the writing key 73 is pressed or not, if the judgment in the step ST110 is Yes, data writing processing is called in a step ST111 and control is returned to the step ST104.

If the judgment in the step ST110 is No, control is returned to the step ST104.

As shown in FIG. 15, in the false feed input processing, the number n of inputs is cleared to zero in a step ST120 and in a step ST121, the current X-Y coordinate values (xc0, yc0) are set to saved X-Y coordinate values (xc0s, yc0s).

Next, in a step ST122, it is judged whether a feed key (the generic name of the +Y key 76, the −Y key 77, the +X key 78 and the −X key 79) is pressed or not and if the judgment in the step ST122 is Yes, inching feed processing is called in a step ST123 and control is returned to the step ST122.

If the judgment in the step ST122 is No, processing proceeds to a next step ST124, it is judged in the step ST124 whether the input key 74 is pressed or not, if the judgment in the step ST124 is Yes, difference between the current X-Y coordinate values (xc0, yc0) and the saved X-Y coordinate values (xc0s, yc0s) is calculated in a next step ST 125, the difference is set as XY movement quantity in an input buffer buf[] not shown, in a next step ST126, the number n of inputs is incremented by one, in a next step ST127, the current X-Y coordinate values (xc0, yc0) are set to saved X-Y coordinate values (xc0s, yc0s) and control is returned to the step ST122.

If the judgment in the step ST124 is No, processing proceeds to a next step ST128, it is judged in the step ST128 whether the termination key 75 is pressed or not and if the judgment in the step ST128 is No, control is returned to the step ST122.

If the judgment in the step ST128 is Yes, processing proceeds to a next step ST129, it is judged in the step ST129 whether there is input or not (n=0?) and if the judgment in the step ST129 is Yes (there is not input, that is, n=0), control is returned to the step ST122.

If the judgment in the step ST129 is No (there is input), processing proceeds to a next step ST130 and false feed data is generated based upon the XY movement quantity stored in the input buffer buf[] and the number n of inputs, a call is made and control is returned. The details of a method of generating the false feed data are omitted.

As shown in FIG. 16, in dotted sewing input processing, the number n of inputs is cleared to zero in a step ST140 and in a step ST141, the current X-Y coordinate values (xc0, yc0) are set to saved X-Y coordinate values (xc0s, yc0s).

Next, in a step ST142, it is judged whether the feed key (the generic name of the +Y key 76, the −Y key 77, the +X key 78 and the −X key 79) is pressed or not and if the judgment in the step ST142 is Yes, inching feed processing is called in a step ST143 and control is returned to the step ST142.

If the judgment in the step ST142 is No, processing proceeds to a next step ST144, it is judged in a step ST144 whether the input key 74 is pressed or not, if the judgment in the step ST144 is Yes, difference between the current X-Y coordinate values (xc0, yc0) and the saved X-Y coordinate values (xc0s, yc0s) is calculated in a next step ST145, the difference is set as XY movement quantity in the input buffer buf[] not shown, in a next step ST146, the number n of inputs is incremented by one, in a next step ST147, the current X-Y coordinate values (xc0, yc0) are set to saved X-Y coordinate values (xc0s, yc0s) and control is returned to the step ST142.

If the judgment in the step ST144 is No, processing proceeds to a next step ST148, it is judged in the step ST148 whether the termination key 75 is pressed or not and if the judgment in the step ST148 is No, control is returned to the step ST142.

If the judgment in the step ST148 is Yes, processing proceeds to a next step ST149, it is judged in the step ST149 whether there is input or not (n=0?) and if the judgment in the step ST149 is Yes (there is no input, that is, n=0), control is returned to the step ST142.

If the judgment in the step ST149 is No (there is input), processing proceeds to a next step ST150, dotted sewing data is generated based upon the XY movement quantity in the input buffer buf[] and the number n of inputs, a call is made and control is returned. The details of a method of generating the dotted sewing data are omitted.

As shown in FIG. 17, in thread cutting input processing, thread cutting data is generated in a step ST160, a call is made and control is returned.

As shown in FIG. 18, in data writing processing, it is judged in a step ST180 whether there is input data such as false feed data, dotted sewing data and thread cutting data or not and if the judgment in the step ST180 is No, a call is made and control is returned.

If the judgment in the step ST180 is Yes, processing proceeds to a next step ST181, in the step ST181, the numerical value input key 67 is pressed and a pattern number for writing is set, input data is written to the storage device 56 such as a floppy disk (FD) using a pattern number set in a next step ST182, a call is made and control is returned.

As shown in FIG. 19, in inching feed processing, in a step ST200 a suitable feed key is selected, if the +X key 78 is pressed, X movement quantity x is set to one and Y movement quantity y is set to zero in a next step ST201, processing proceeds to a next step ST205, if the −X key 79 is pressed, X movement quantity x is set to −1 and Y movement quantity y is set to zero in a next step ST202, processing proceeds to the next step ST205, if the +Y key 76 is pressed, X movement quantity x is set to zero and Y movement quantity y is set to one in a next step ST203, processing proceeds to the next step ST205, if the −Y key 77 is pressed, X movement quantity x is set to zero and Y movement quantity y is set to −1 in a next step ST204 and processing proceeds to the next step ST205.

Next, in the step ST205, xy movement quantity (x, y) is added to the current X-Y coordinate values (xc0, yc0), in a next step ST206, calculation for XY correction values is called, the number (t, r) of pulses of each pulse motor (θ/R motor) 7 and 8 is calculated, processing proceeds to a next step ST207, difference between the number (t, r) of pulses of each pulse motor 7 and 8 calculated in the step ST207 and the current number (tc0, rc0) of pulses of each pulse motor 7 and 8 is calculated, the difference is set as the number (tp, rp) of driven pulses equivalent to the driven quantity of each pulse motor 7 and 8, in a next step ST208, θ and R motors 7 and 8 are driven by the number (tp, rp) of driven pulses, in a next step ST209, the number (t, r) of pulses is set to the current number (tc0, rc0) of pulses and processing proceeds to a next step ST210. The details of a method of driving θ and R motors 7 and 8 are omitted.

Next, in the step ST210, it is judged whether the feed key is turned off or not, if the judgment in the step ST210 is No (the feed key is on), control is returned to the step ST205, while the feed key is on, θ and R motors 7 and 8 are continuously driven, if the judgment in the step ST210 is Yes, a call is made and control is returned.

As shown in FIG. 20, in the calculation for XY correction values (the above second method of calculating a correction value shown in FIG. 11), in a step ST220, left-hand lower X-Y coordinate values (x1, y1) and right-hand upper X-Y coordinate values (xh, yh) respectively where a correction value exists are set based upon the current X-Y coordinate values (xc0, yc0), in a next step ST221, an X correction value for left-hand lower X-Y coordinate values (x1, y1) is set in c1, in a next step ST222, an X correction value for left-hand upper X-Y coordinate values (x1, yh) is set in c2 and in a next step ST223, a value obtained by complementarily adding the current y-coordinate yc0, lower y-coordinate y1 and difference 10 between lower y-coordinate and upper y-coordinate to c1 and c2 is set in c3. Next, in a step ST224, an X correction value for right-hand lower X-Y coordinate values (xh, y1) is set in c1, in a next step ST225, an X correction value for right-hand upper X-Y coordinate values (xh, yh) is set in c2 and in a next step ST226, a value obtained by complementarily adding the current y-coordinate yc0, lower y-coordinate y1 and difference 10 between lower y-coordinate and upper y-coordinate to c1 and c2 is set in c4.

Next, in a step ST227, a value obtained by complementarily adding the current x-coordinate xc0, left-hand x-coordinate x1 and difference 10 between left-hand x-coordinate and right-hand x-coordinate to c3 and c4 is set as xc.

Next, in a step ST228, a Y correction value for left-hand lower X-Y coordinate values (x1, y1) is set in c1, in a next step ST229, a Y correction value for right-hand lower X-Y coordinate values (xh, y1) is set in c2, in a next step ST230, a value obtained by complementarily adding the current x-coordinate xc0, left-hand x-coordinate x1 and difference 10 between left-hand x-coordinate and right-hand x-coordinate to c1 and c2 is set in c3, in a next step ST231, a Y correction value for left-hand upper X-Y coordinate values (x1, hy) is set in c1, in a next step ST232, a Y correction value for right-hand upper X-Y coordinate values (xh, yh) is set in c2 and in a next step ST232, a value obtained by complementarily adding the current x-coordinate xc0, left-hand x-coordinate x1 and difference 10 between left-hand x-coordinate and right-hand x-coordinate to c1 and c2 is set in c4.

Next, in a step ST234, a value obtained by complementarily adding the current y-coordinate yc0, lower y-coordinate y1 and difference 10 between lower y-coordinate and upper y-coordinate to c3 and c4 is set as yc.

Next, in a step ST235, the current X-Y coordinate values (xc0, yc0) and XY correction values (xc, yc) are added and set as the number (t, r) of pulses, a call is made and control is returned.

Data input is terminated by storing each value obtained as described above in the storage device 56.

The present invention can be also readily applied to a contour sewing machine in which the driving force of a pair of driving motors 7 and 8 is converted to approximate linear motion called driving in a circular arc and sewing holding means 5 is moved in longitudinal and transverse two directions approximately perpendicular along the surface of a bed 2. The detailed description of expressions for calculation and correction values in this case is omitted.

The present invention is also not limited to the above embodiments and if necessary, may be varied.

As described above, according to the sewing movement control method according to the present invention, sewing data can be shared independent of difference between the methods (XY driving and driving in a circular arc) of moving the sewing holding means by a pair of driving motors. That is, as sewing data when the existing sewing holding means is moved in the directions of X and Y can be shared as sewing data in case at least one of the mutually different moved directions of the sewing holding means is driving in a circular arc by composing sewing data of coordinate values at rectangular coordinates (the X-Y coordinates), labor and time required to generate the sewing data can be reduced. Further, as the driven quantity of the driving motors can be readily corrected based upon sewing data so that the driven quantity is a suitable value in the correction table independent of a case that at least one of the mutually different moved directions of the sewing holding means is driving in a circular arc, the enlargement or reduction of a contour when at least one of the mutually different moved directions of the sewing holding means is driving in a circular arc, difference in size between sewing areas when at least one of the mutually different moved directions of the sewing holding means is driving in a circular arc and others, extremely excellent effect that the suitable moved position of the sewing holding means can be securely obtained and as a result, the distortion of a contour in case at least one of the mutually different moved directions of the sewing holding means is driving in a circular arc and contour sewing is executed can be readily and securely prevented is produced.

According to the contour sewing machine according to the present invention, as the sewing movement control method according to the present invention can be readily executed, sewing data can be shared independent of difference between the methods (XY driving and driving in a circular arc) of moving the sewing holding means by a pair of driving motors. That is, as the existing sewing data of a contour sewing machine in which sewing holding means is moved in the directions of X and Y can be shared as sewing data of a contour sewing machine in which at least one of the mutually different moved directions of the sewing holding means is driving a circular arc, labor and time required to generate sewing data can be reduced. Further, as the driven quantity of the driving motors can be readily corrected based upon sewing data so that the driven quantity is a suitable value in the correction table independent of a case that at least one of the mutually different moved directions of the sewing holding means is driving a circular arc, the enlargement or reduction of a contour when at least one of the mutually different moved directions of the sewing holding means is driving a circular arc, difference in size between sewing areas when at least one of the mutually different moved directions of the sewing holding means is driving a circular arc and others, the suitable moved position of the sewing holding means can be securely obtained and as a result, as the distortion of a contour in case the sewing holding means is moved in a circular arc and contour sewing is executed can be readily and securely prevented, extremely excellent effect that predetermined contour sewing can be suitably and securely executed is also produced. Furthermore, as sewing data can be shared, an input device required to generate sewing data is not required to be provided every machine. That is, extremely excellent effect that sewing data can be generated by a personal computer and others is also produced.

Extremely excellent effect that quantity in which the sewing holding means is moved as sewing data can be readily converted to coordinate values at rectangular coordinates in a moved position by providing data conversion means for converting the quantity in which the sewing holding means is moved as sewing data to coordinate values in the moved position is also produced.

Extremely excellent effect that according to the correction table in which a correction value is given only to coordinate values at a fixed interval at rectangular coordinates, the quantity of data can be reduced and as a result, the storage capacity of the correction table storage means for storing the correction table can be reduced is also produced.

Extremely excellent effect that even if a correction value is not found in the correction table, a suitable correction value can be readily obtained by using a correction value for coordinate values in the correction table which are the nearest to coordinate values in the moved position from the home position of the sewing holding means as a correction value for coordinate values in the moved position from the home position of the sewing holding means if a correction value for coordinate values in the moved position from the home position of the sewing holding means is not found in the correction table and as a result, predetermined contour sewing can be suitably and readily executed using the correction table the quantity of data of which is small is also produced.

Extremely excellent effect that even if a correction value is not found in the correction table, a more suitable correction value can be readily obtained by complementarily calculating each correction value for coordinate values at four points in the correction table which are the nearest to coordinate values in the moved position from the home position of the sewing holding means based upon the coordinate values at four points in the correction table and coordinate values in the moved position from the home position of the sewing holding means if a correction value for coordinate values in the moved position from the home position of the sewing holding means is not found in the correction table and using a value calculated in the complementary calculation as a correction value for coordinate values in the moved position from the home position of the sewing holding means and as a result, predetermined contour sewing can be more suitably and readily executed using the correction table the quantity of data of which is small is also produced.

Therefore, according to the sewing movement control method and the contour sewing machine respectively according to the present invention, extremely excellent effect that sewing data can be shared independent of difference in a driving method and in a sewing area is also produced.

What is claimed is:

1. A contour sewing machine, comprising:

a workpiece holder;

a pair of driving motors for driving said workpiece holder in an x-y rectangular coordinate plane in a series of motions relative to a position of a needle, wherein at least one of said series of motions is approximately linear in one of the x and y directions;

a first storing means for storing sewing data including x-y coordinate values representing respective x-y coordinate plane positions to which said workpiece holder is moved;

a second storing means for storing coordinate correction data for correcting a driven quantity of a motion of at least one of said driving motors; and a controller for controlling said driving motors based on said sewing data and said correction data, to thereby move said workpiece holder in a predetermined position.

2. The contour sewing machine according to claim 1, further comprising:

a data output means for outputting said sewing data from said first storing means;

wherein said coordinate correction data is stored in said second storing means as a correction table.

3. A contour sewing machine, comprising:

a sewing holding means which can be moved with holding sewing;

a pair of driving motors;

a sewing conveyance means for conveying the driving force of said pair of driving motors by converting at least one of the driving force of said pair of driving motors to approximate linear motion and converting the other to approximate linear motion or linear motion so that said sewing holding means is moved in longitudinal and transverse two directions approximately perpendicular along the surface of a bed;

an auxiliary storage in which sewing data composed of quantity in which said sewing holding means is moved on rectangular coordinates in longitudinal and transverse two directions mutually perpendicular is stored;

data input means from/to which sewing data stored in said auxiliary storage can be read or can be read and written;

data conversion means for converting quantity in which said sewing holding means is moved as said sewing data to coordinate values in the moved position;

correction table storage means for storing a correction table for correcting the driven quantity of said each driving motor corresponding to coordinate values converted from said sewing data; and control means for controlling the driven quantity of said pair of driving motors based upon values obtained based upon coordinate values in a position to which said sewing holding means is moved and said correction table.

4. The contour sewing machine according to claim 2 or 3, wherein:

in said correction table, a correction value is given to only coordinate values at a fixed interval at said rectangular coordinates.

5. The contour sewing machine according to claim 4, wherein:

said control means uses the correction values of coordinate values in a correction table the nearest to coordinate values in a position to which said sewing holding means is moved from a home position as the correction values of coordinate values in a position to which said sewing holding means is moved from the home position if the correction values of coordinate values in the position to which said sewing holding means is moved from the home position are not found in said correction table.

6. The contour sewing machine according to claim 4, wherein:

said control means complementarily calculates each correction value of coordinate values in a correction table at four points the nearest to coordinate values in a position to which said sewing holding means is moved from a home position based upon the coordinate values in said correction table at said four points and coordinate values in a position to which said sewing holding means is moved from the home position if the correction values of the coordinate values in the position to which said sewing holding means is moved from the home position are not found in said correction table; and said control means uses values calculated in said complementary calculation as the correction values of coordinate values in a position to which said sewing holding means is moved from the home position.

7. The contour sewing machine according to claim 1 or 2, wherein the coordinate correction data is calculated according to a resolution of said driving motors.

8. A contour sewing machine according to claim 1 or 2, wherein the coordinate correction data is calculated according to an offset value of the at least one approximately linear motion.

9. An contour sewing machine, comprising:

a workpiece holder;

a pair of driving motors for driving said workpiece holder in an x-y rectangular coordinate plane in a series of motions relative to a position of a needle, wherein at least one of said series of motions is approximately linear in one of the x and y directions;

sewing data including x-y coordinate values representing respective x-y coordinate plane positions to which said workpiece holder is moved from a home position;

coordinate correction data for correcting a driven quantity of a motion of at least one of said driving motors; and a controller for controlling said driving motors based on said sewing data and said correction data, to thereby move said workpiece holder in a predetermined contour direction.

* * * * *